US009160089B2

(12) United States Patent
Shimoji

(10) Patent No.: US 9,160,089 B2
(45) Date of Patent: Oct. 13, 2015

(54) WIRE-TO-BOARD CONNECTOR

(71) Applicant: Japan Aviation Electronics Industry, Ltd., Tokyo (JP)

(72) Inventor: Kenichi Shimoji, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 250 days.

(21) Appl. No.: 13/672,193

(22) Filed: Nov. 8, 2012

(65) Prior Publication Data

US 2013/0137314 A1 May 30, 2013

(30) Foreign Application Priority Data

Nov. 25, 2011 (JP) ..... 2011-256969

(51) Int. Cl.

| | |
|---|---|
| ***H01R 13/62*** | (2006.01) |
| ***H01R 12/70*** | (2011.01) |
| ***H01R 12/50*** | (2011.01) |
| ***H01R 13/04*** | (2006.01) |

(Continued)

(52) U.S. Cl.

CPC ..... *H01R 12/7082* (2013.01); *H01R 12/728* (2013.01); *H01R 12/75* (2013.01); *H01R 13/04* (2013.01); *H01R 13/2442* (2013.01); *H01R 13/62* (2013.01); *H01R 23/727* (2013.01); *H01R 13/428* (2013.01); *H01R 13/6275* (2013.01); *H01R 13/642* (2013.01)

(58) Field of Classification Search

USPC ..... 439/329, 876, 78, 83, 866, 845, 849, 439/850

See application file for complete search history.

(56) References Cited

U.S. PATENT DOCUMENTS 3,915,535 A * 10/1975 O'Keefe et al. ..... 439/63
5,383,788 A 1/1995 Spencer (Continued)

FOREIGN PATENT DOCUMENTS

CN 1174422 A 2/1998
CN 1255755 A 6/2000

(Continued)

OTHER PUBLICATIONS

Korean Office Action dated Oct. 23, 2013, as issued in corresponding Korean Patent Application Serial No. 10-2012-0122766.

(Continued)

*Primary Examiner* — Abdullah Riyami
*Assistant Examiner* — Harshad Patel
(74) *Attorney, Agent, or Firm* — Maier & Maier, PLLC

(57) ABSTRACT

Provided is a wire-to-board connector including a plug attached to a wire, and a receptacle mounted on a circuit board. The plug and the receptacle are formed of metal. The plug is fitted into the receptacle to electrically connect the wire to the circuit board. The receptacle has an accommodating portion formed in a tubular shape. The plug has an inserted portion to be inserted into the accommodating portion of the receptacle. The inserted portion includes a body plate and an elastic piece elastically supported in a cantilevered manner by the body plate. The elastic piece of the inserted portion has a free end. The accommodating portion has an engaged portion. When the inserted portion is inserted into the accommodating portion, the free end engages with the engaged portion along with an elastic deformation of the elastic piece, thereby allowing the plug to be fitted into the receptacle.

19 Claims, 21 Drawing Sheets

(51) Int. Cl.

| | |
|---|---|
| ***H01R 12/72*** | (2011.01) |
| ***H01R 12/75*** | (2011.01) |
| ***H01R 13/24*** | (2006.01) |
| *H01R 13/428* | (2006.01) |
| *H01R 13/627* | (2006.01) |
| *H01R 13/642* | (2006.01) |

(56) References Cited

U.S. PATENT DOCUMENTS

| | | | | |
|---|---|---|---|---|
| 5,951,336 | A | 9/1999 | Seko et al. | |
| 6,257,912 | B1 | 7/2001 | Boillot et al. | |
| 7,329,158 | B1 | 2/2008 | Roberts et al. | |
| 7,497,715 | B2 * | 3/2009 | Wu | 439/329 |
| 2004/0192109 | A1 | 9/2004 | Fukatsu et al. | |
| 2008/0305668 | A1 | 12/2008 | Wu | |
| 2010/0210154 | A1 | 8/2010 | Boemmel et al. | |
| 2011/0124244 | A1 * | 5/2011 | Osvatic et al. | 439/819 |

FOREIGN PATENT DOCUMENTS

| | | | |
|---|---|---|---|
| CN | 1536716 | A | 10/2004 |
| CN | 101790819 | A | 7/2010 |
| EP | 1566860 | A1 | 8/2005 |
| FR | 2850797 | A1 | 8/2004 |
| JP | 6349555 | A | 12/1994 |
| JP | 2003-059580 | A1 | 2/2003 |
| JP | 03323930 | A | 11/2003 |
| JP | 2010-186663 | A | 8/2010 |
| KR | 20-0243884 | B1 | 10/2001 |
| WO | 2012127541 | A1 | 9/2012 |

OTHER PUBLICATIONS

Office Action issued on Jun. 30, 2014 in corresponding Taiwanese Patent Application No. 101140289.

European Search Report and Written Opinion issued on Jan. 25, 2013 in counterpart foreign application 12192729.7-1231. 9 pages.

International Search Report and Office Action dated Sep. 3, 2014 from corresponding Chinese Patent Application No. CN 201210432168.0; 10 pgs.

Japanese Office Action dated Jun. 2, 2015, in connection with JP Application No. 2011-256969 (6 pgs.).

Extended European Search Report dated Aug. 7, 2015, in connection with corresponding EP Application No. 15166153.5 (8 pgs).

* cited by examiner

WIRE-TO-BOARD CONNECTOR

RELATED APPLICATIONS

This application claims priority under 35 U.S.C. §119 to Japanese Patent Application No. 2011-256969, filed Nov. 25, 2011, the disclosure of which is incorporated by reference herein in its entirety.

BACKGROUND OF THE INVENTION

1. Field of the Invention

The present invention relates to a wire-to-board connector.

2. Description of Related Art

As a technique of this type, Japanese Unexamined Patent Application Publication No. 2010-186663 discloses a structure in which a wire-side fast-on tab terminal 103 with a wire 102 is connected to a low-height type surface mounting fast-on tab terminal 101 which is mounted on the surface of a circuit board 100 as shown in FIG. 21 of the present invention.

SUMMARY OF THE INVENTION

In the structure disclosed in Japanese Unexamined Patent Application Publication No. 2010-186663 described above, however, when an external force acts on the wire 102, the wire-side fast-on tab terminal 103 is easily removed from the low-height type surface mounting fast-on tab terminal 101.

It is an object of the present invention to provide a wire-to-board connector that prevents a fitted state from being easily released even when an external force acts on a wire.

According to an aspect of the present invention, there is provided a wire-to-board connector including a first terminal attached to a wire, and a second terminal mounted on a circuit board, the first terminal and the second terminal being formed of metal and fitted together to electrically connect the wire to the circuit board. The second terminal includes an accommodating portion formed in a tubular shape. The first terminal includes an inserted portion to be inserted into the accommodating portion of the second terminal. The inserted portion includes a body plate and an elastic piece, the elastic piece being elastically supported in a cantilevered manner by the body plate. The elastic piece of the inserted portion has a first engagement portion, and the accommodating portion has a second engagement portion. When the inserted portion is inserted into the accommodating portion, the first engagement portion engages with the second engagement portion along with an elastic deformation of the elastic piece, thereby allowing the first terminal to be fitted into the second terminal.

Preferably, the elastic piece extends in a removing direction, the removing direction being a direction opposite to an inserting direction in which the inserted portion is inserted into the accommodating portion.

Preferably, the first engagement portion and the second engagement portion engage with each other in substantially parallel to the inserting direction.

Preferably, the accommodating portion has an inner protrusion protruding toward an inner peripheral side of the accommodating portion, and the inner protrusion functions as the second engagement portion.

Preferably, the inner protrusion is formed by bending an end in the removing direction of the accommodating portion.

Preferably, the inner protrusion is formed by bending the end in the removing direction of the accommodating portion by about 180 degrees.

Preferably, the elastic piece contacts an inner peripheral surface of the accommodating portion near the first engagement portion due to a spring elastic force of the elastic piece, in a state where the first engagement portion and the second engagement portion engage with each other.

Preferably, the elastic piece has a contact portion that contacts the accommodating portion due to a spring elastic force of the elastic piece, in a state where the first engagement portion and the second engagement portion engage with each other.

Preferably, the elastic piece has an externally exposed portion that is exposed to an outside without being covered by the accommodating portion, in a state where the first engagement portion and the second engagement portion engage with each other.

Preferably, the externally exposed portion has a pressing area, the pressing area being formed such that the externally exposed portion connects to a free end of the elastic piece and protrudes in at least one of a connector width direction and a connector inserting/removing direction.

Preferably, the first terminal has an excessive insertion preventing portion that contacts the second terminal to prevent excessive insertion of the inserted portion into the accommodating portion.

Preferably, the accommodating portion has a slit formed therein; the inserted portion has an erroneous insertion preventing portion to be inserted into the slit; and the erroneous insertion preventing portion serves as the excessive insertion preventing portion.

Preferably, the accommodating portion has a slit formed therein, and the inserted portion has an erroneous insertion preventing portion to be inserted into the slit.

Preferably, the inserted portion has a pair of side plates opposed to each other.

Preferably, the elastic piece is formed between the pair of side plates.

Preferably, the accommodating portion includes: a base plate located on a side of the circuit board; a top plate; and a pair of side plates that couple the top plate with the base plate, and the accommodating portion is formed in a substantially angular cylindrical shape.

Preferably, the base plate of the accommodating portion extends in a removing direction, the removing direction being a direction opposite to an inserting direction in which the inserted portion is inserted into the accommodating portion.

Preferably, the base plate of the accommodating portion has a contact spring piece that is formed in a cantilevered manner and contacts the inserted portion inserted into the accommodating portion.

Preferably, the accommodating portion is formed in a tubular shape by sheet metal bending; a shape holding mechanism for holding a tubular shape of the accommodating portion is formed near a joint of the accommodating portion; and the shape holding mechanism is implemented by a shape holding projection and a shape holding projection accommodating hole that accommodates the shape holding projection.

Preferably, the inserted portion includes a pair of side plates opposed to each other, at least one of the pair of side plates having an excessive insertion preventing portion that contacts the accommodating portion to prevent excessive insertion of the inserted portion into the accommodating portion.

Preferably, the excessive insertion preventing portion contacts a part of an edge surface of the accommodating portion in a removing direction to prevent excessive insertion of the inserted portion into the accommodating portion, the removing direction being a direction opposite to an inserting direction in which the accommodating portion is inserted into the accommodating portion.

According to the present invention, the amount of displacement of the first engagement portion upon engagement of the first engagement portion with the second engagement portion can be effectively secured, thereby ensuring the engagement between the first engagement portion and the second engagement portion. This prevents the fitted state of the wire-to-board connector from being easily released even when an external force acts on the wire.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS (First Exemplary Embodiment)

A first exemplary embodiment of the present invention will be described below with reference to FIGS. 1 to 19.

Figure 1:
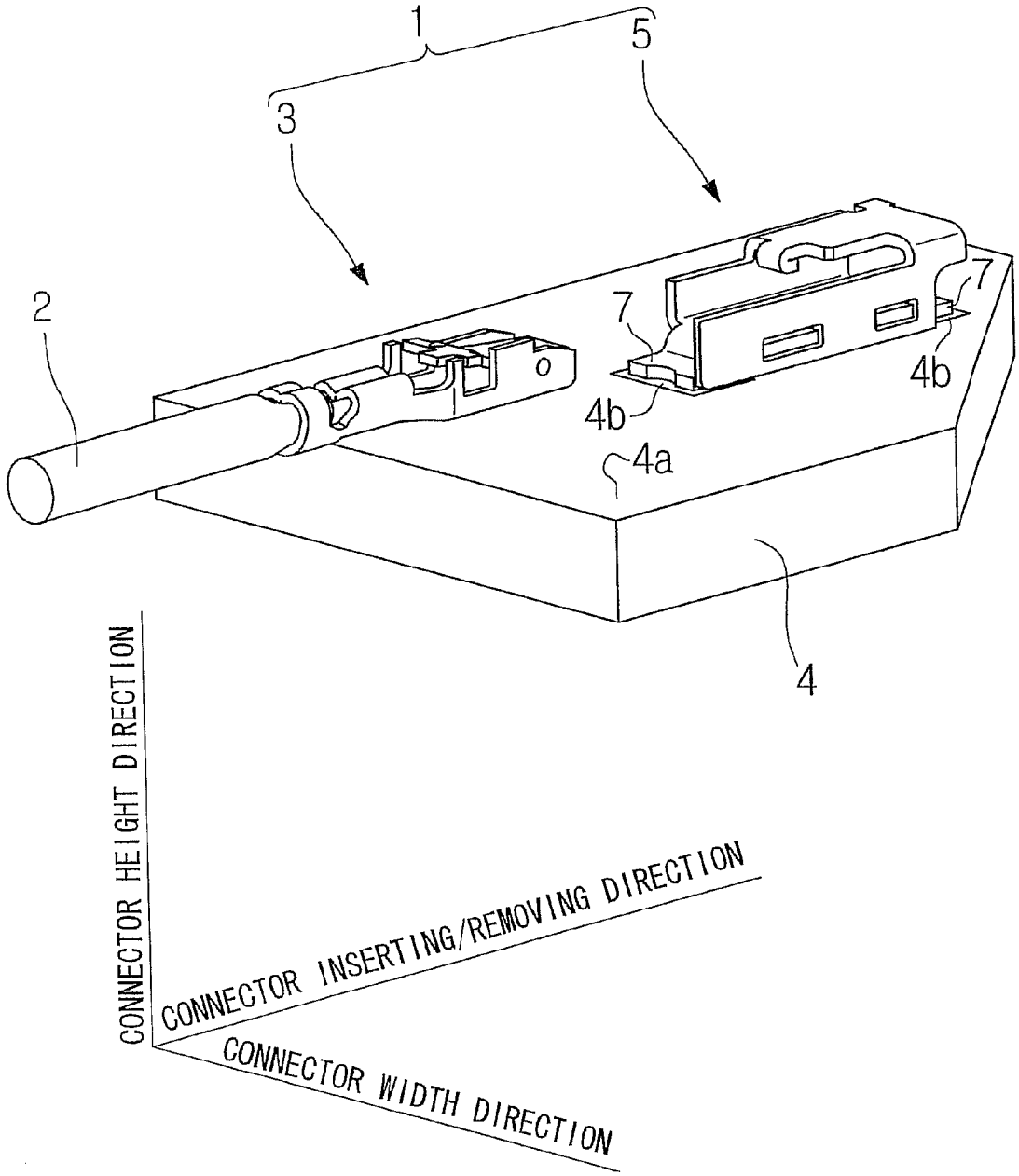
FIG. 1 is a perspective view of a wire-to-board connector in a non-fitted state (first exemplary embodiment)
Figure 2:
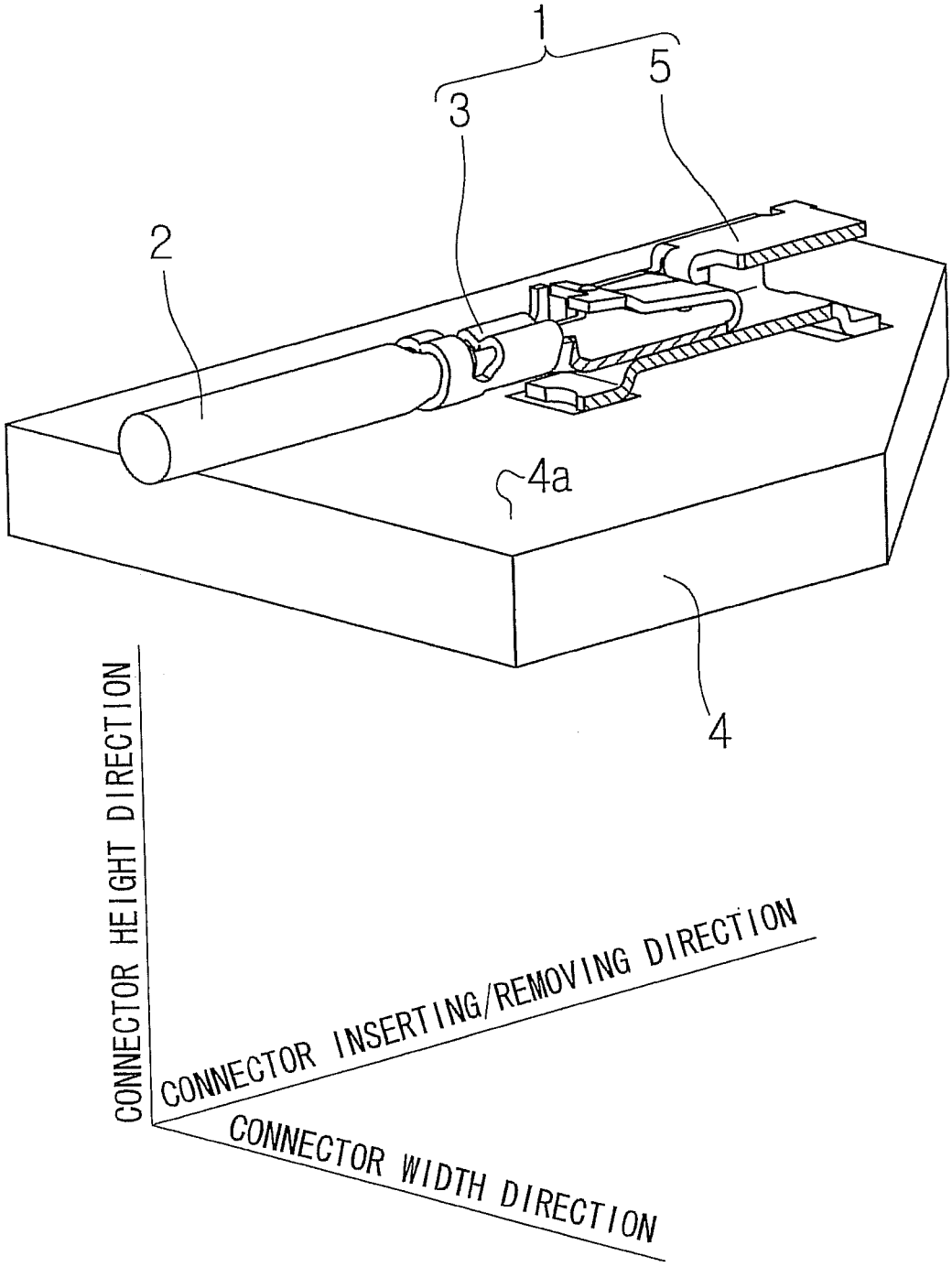
FIG. 2 is a partially cutaway perspective view of the wire-to-board connector in a half-fitted state (first exemplary embodiment)
Figure 3:
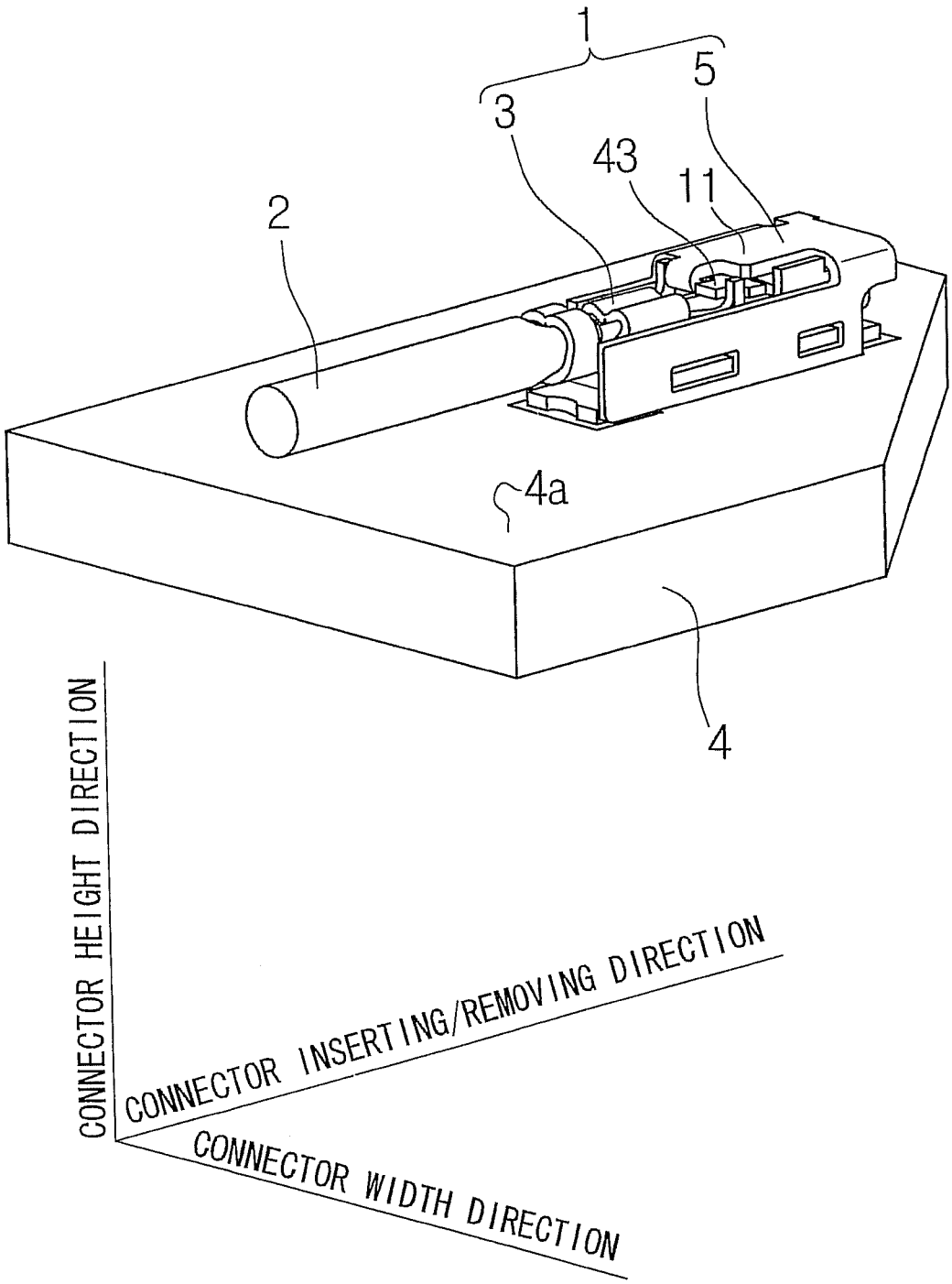
FIG. 3 is a perspective view of the wire-to-board connected in a fitted state (first exemplary embodiment)

As shown in FIG. 1, a wire-to-board connector 1 includes a plug 3 (first terminal) which is attached to a wire 2, and a receptacle 5 (second terminal) which is mounted on the surface of a circuit board 4. In the first exemplary embodiment, the plug 3 and the receptacle 5 are each formed of metal, and are integrally formed by sheet metal bending. As shown in FIGS. 1 to 3, the plug 3 is fitted into the receptacle 5, thereby electrically connecting the wire 2 to the circuit board 4.

Here, the terms "connector inserting/removing direction", "connector height direction", and "connector width direction" are defined. As shown in FIGS. 1 to 3, the term "connector inserting/removing direction" refers to a direction in which the plug 3 is inserted/removed into/from the receptacle 5. The "connector inserting/removing direction" includes "an inserting direction" and "a removing direction". The term "inserting direction" refers to a direction in which the plug 3 is inserted into the receptacle 5. The term "removing direction" refers to a direction in which the plug 3 is removed from the receptacle 5. The term "connector height direction" refers to a direction orthogonal to a connector mounting surface 4*a* of the circuit board 4. The "connector height direction" includes "a mounting surface approaching direction" and "a mounting surface separating direction". The term "mounting surface approaching direction" refers to a direction approaching the connector mounting surface 4*a* of the circuit board 4. The term "mounting surface separating direction" refers to a direction separating from the connector mounting surface 4*a* of the circuit board 4. The term "connector width direction" refers to a direction orthogonal to each of the "connector inserting/removing direction" and the "connector height direction". The "connector width direction" includes "a connector width center direction" and "a connector width anti-center direction". The term "connector width center direction" refers to a direction toward the center in the connector width direction of the wire-to-board connector 1 (plug 3, receptacle 5). The term "connector width anti-center direction" refers to a direction separating from the center in the connector width direction of the wire-to-board connector 1 (plug 3, receptacle 5).

(Receptacle 5: FIGS. 4 to 8)

As shown in FIGS. 4 to 8, the receptacle 5 includes a receptacle body 6 and a pair of mounting portions 7.

(Receptacle 5: Receptacle body 6)

Figure 4:
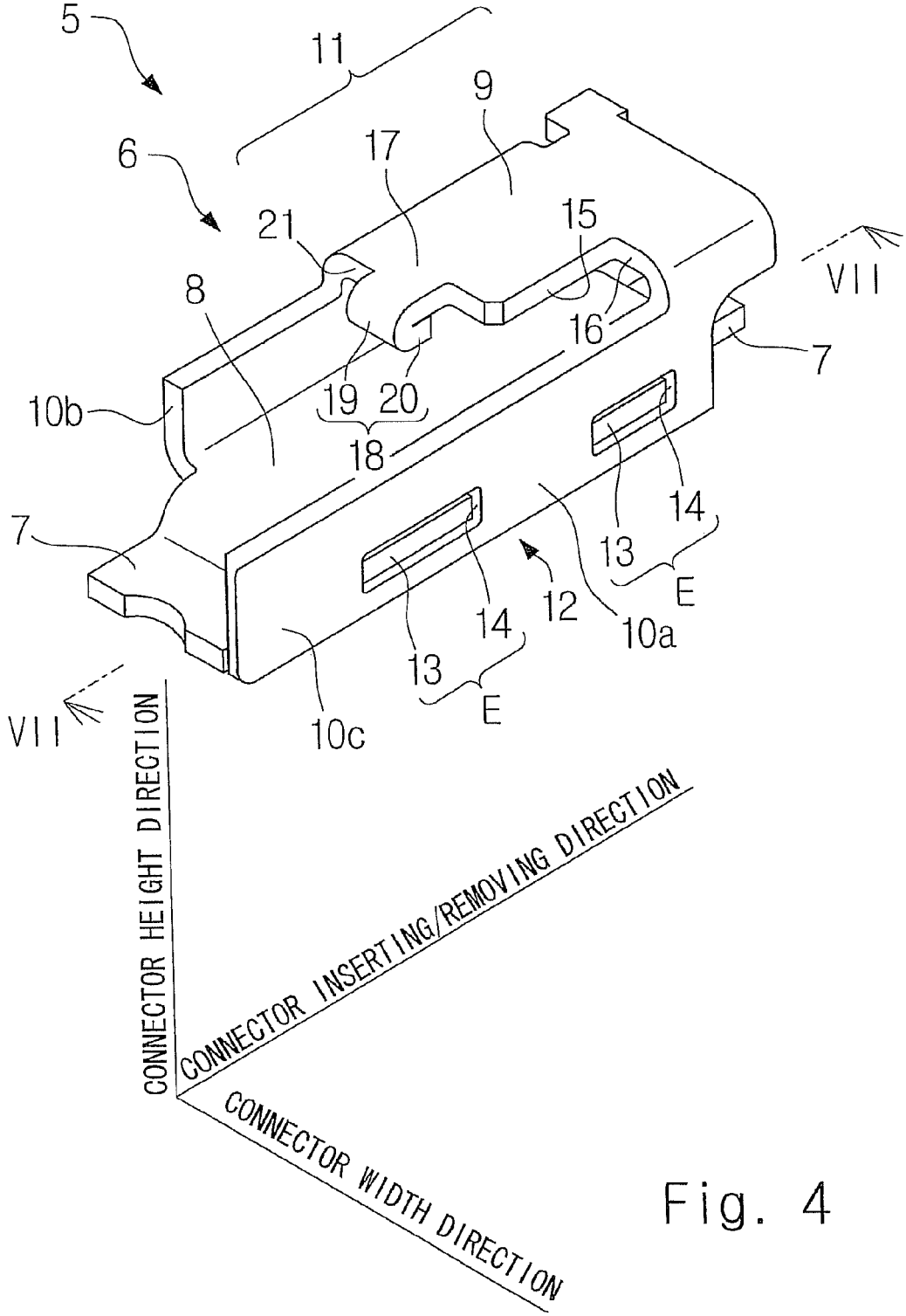
FIG. 4 is a perspective view of a receptacle (first exemplary embodiment)

The receptacle body 6 is a portion that receives the plug 3. As shown in FIG. 4, the receptacle body 6 includes a base plate 8 formed on the side of the circuit board 4 (also see FIG. 1), a top plate 9 and side plates 10*a* and 10*b* which couple the base plate 8 with the top plate 9. The base plate 8 and the top plate 9 are disposed substantially parallel to the connector mounting surface 4*a* (also see FIG. 1) of the circuit board 4. The side plates 10*a* and 10*b* are disposed substantially orthogonal to the connector mounting surface 4*a* of the circuit board 4. The side plate 10*a* is disposed on the right side when the receptacle body 6 is viewed along the inserting direction. The side plate 10*b* is disposed on the left side when the receptacle body 6 is viewed along the inserting direction.

In the first exemplary embodiment, the top plate 9 is formed to be shorter in the connector inserting/removing direction than the base plate 8, the side plate 10*a*, and the side plate 10*b*, and is disposed on the back side in the inserting direction. Accordingly, the receptacle body 6 includes an accommodating portion 11 which has a substantially angular cylindrical shape and which is located at a position on the back side in the inserting direction. The accommodating portion 11 is formed of the base plate 8, the top plate 9, and the side plates 10*a* and 10*b*. Thus, it can be said that the accommodating portion 11 is formed in a tubular shape by sheet metal bending.

A joint 12 exists between the base plate 8 and the side plate 10*a*. Two shape holding mechanisms E are formed in the vicinity of the joint 12. The two shape holding mechanisms E allow the base plate 8 and the side plate 10*a* to be coupled together. Each shape holding mechanism E is implemented by a shape holding projection 13 which is formed on the base plate 8, and a shape holding projection accommodating hole 14 which is formed in the side plate 10*a*. In other words, a pair of shape holding projections 13 formed on the base plate 8 is accommodated in a pair of shape holding projection accommodating holes 14 formed in the side plate 10*a*, thereby coupling the base plate 8 and the side plate 10*a* together. Due to the presence of the shape holding mechanisms E, the tubular shape of the accommodating portion 11 is held.

A plug guide portion 10*c* that is not opposed to the side plate 10*b* in the connector width direction is provided on the side of the removing direction of the side plate 10*a*.

(Receptacle 5: Receptacle Body 6: Top Plate 9)

Figure 8:
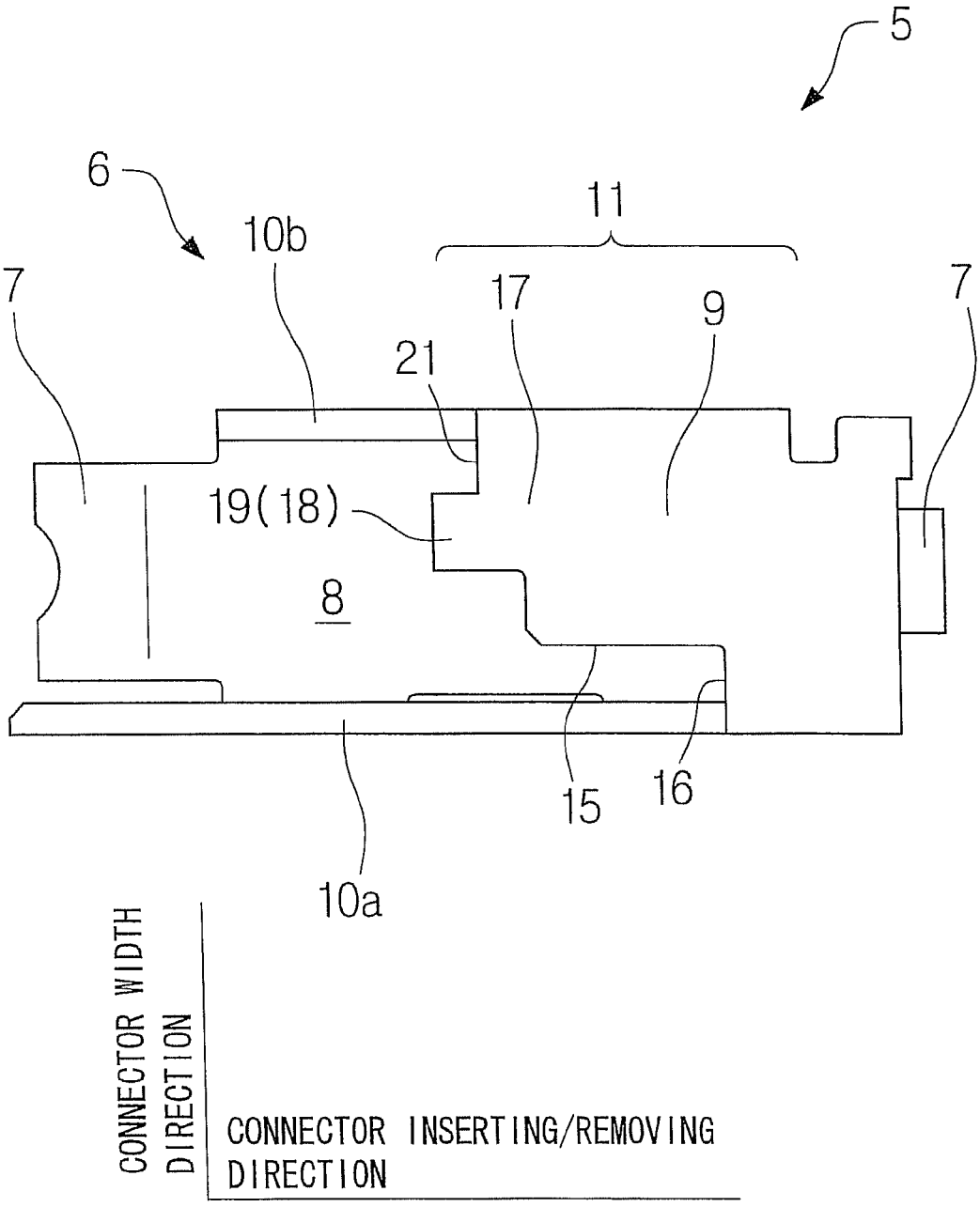
FIG. 8 is a plan view of the receptacle (first exemplary embodiment)

As shown in FIGS. 4 and 8, the accommodating portion 11 has a slit 15. Specifically, the slit 15 extends in the connector inserting/removing direction across the top plate 9 and the side plate 10*a*, which constitute the accommodating portion 11, and is opened in the removing direction. The top plate 9 of the accommodating portion 11 has a slit defining edge surface 16 that defines the slit 15 in the connector inserting/removing direction. The slit defining edge surface 16 is a part of the edge surface in the removing direction of the top plate 9 of the accommodating portion 11. The slit defining edge surface 16 is substantially orthogonal to the connector inserting/removing direction.

Figure 7:
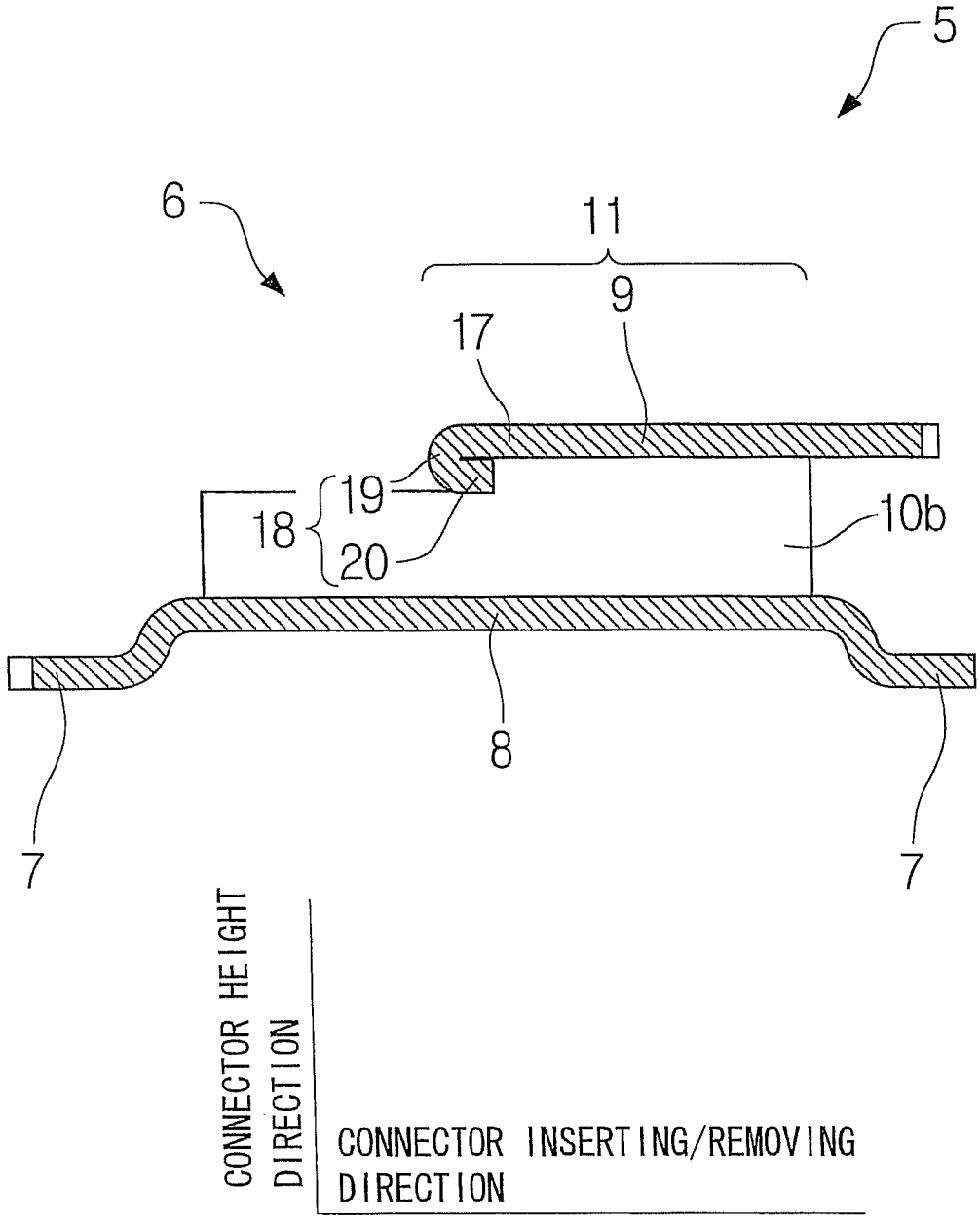
FIG. 7 is a sectional view taken along the line VII-VII of FIG. 4 (first exemplary embodiment)

As shown in FIGS. 4, 7, and 8, a receptacle-side engaging portion 18 is formed at an end 17 in the removing direction of the top plate 9. Specifically, the receptacle-side engaging portion 18 is formed at a position which is located at substantially the center in the connector width direction of the end 17 in the removing direction of the top plate 9, and which is slightly closer to the side plate 10*b*. The receptacle-side engaging portion 18 includes a curved portion 19 and an engaged portion 20 (an inside protruding portion, a second engagement portion). The curved portion 19 is connected to the end 17 in the removing direction of the top plate 9 and is formed to be curved in the removing direction, the mounting surface approaching direction, and the inserting direction in this order. The engaged portion 20 is connected to the curved portion 19 and extends in the inserting direction. It can be said that the engaged portion 20 is supported by the top plate 9 through the curved portion 19 that is curved, thereby being allowed to protrude toward the inner periphery of the accommodating portion 11. It can also be said that the engaged portion 20 is formed by bending, by about 180 degrees, the end 17 in the removing direction of the accommodating portion 11. The engaged portion 20 is substantially tightly opposed to the top plate 9.

As shown in FIGS. 4 and 8, a stopper edge surface 21 is formed at the end 17 in the removing direction of the top plate 9 of the accommodating portion 11. The stopper edge surface 21 is a part of the edge surface in the removing direction of the top plate 9 of the accommodating portion 11. The stopper edge surface 21 is formed at a position closer to the side plate 10*b* than the receptacle-side engaging portion 18. The stopper edge surface 21 is substantially orthogonal to the connector inserting/removing direction.

(Receptacle 5: Mounting Portions 7)

Figure 5:
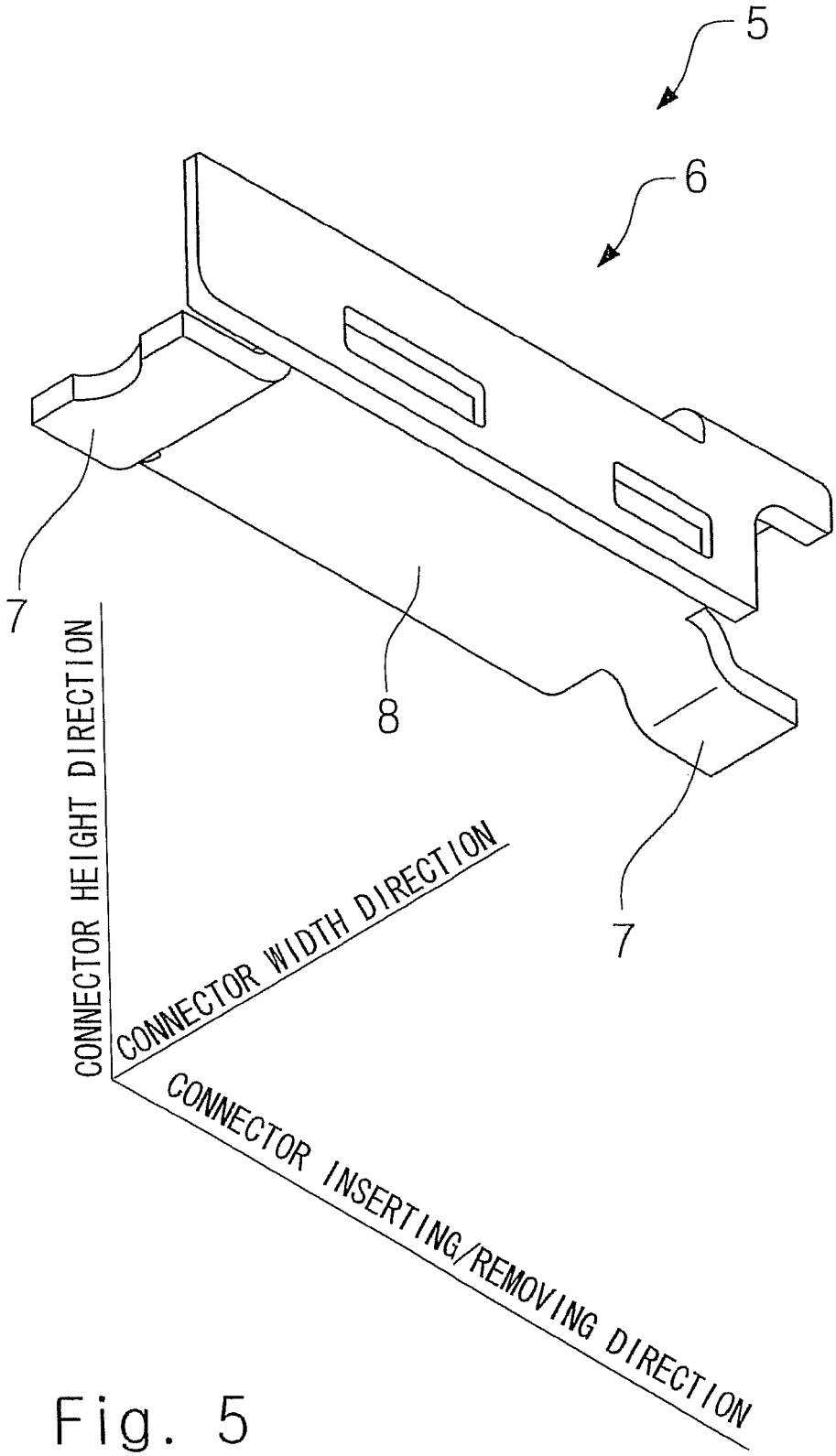
FIG. 5 is a perspective view of the receptacle when viewed from another angle (first exemplary embodiment)

As shown in FIGS. 5 and 7, the pair of mounting portions 7 is disposed so as to sandwich the base plate 8 and is connected to the base plate 8. The pair of mounting portions 7 is disposed with a deviation in the mounting surface approaching direction with respect to the base plate 8.

Figure 9:
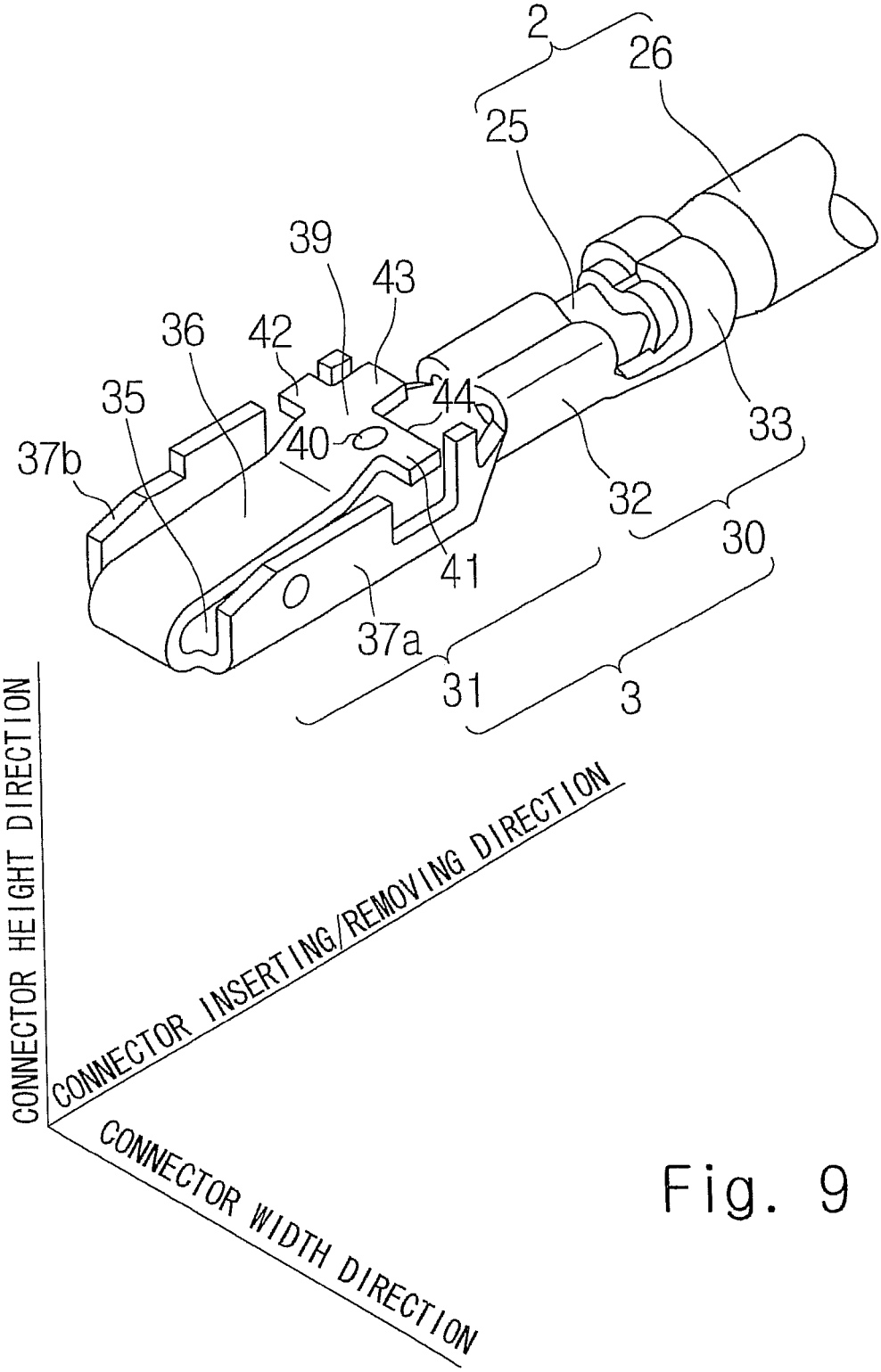
FIG. 9 is a perspective view of a plug connected with a wire (first exemplary embodiment)

(Wire 2: FIG. 9)

The wire 2 includes a strand wire 25 and an insulation 26. The strand wire 25 is coated with the insulation 26.

(Plug 3: FIGS. 9 to 12)

As shown in FIG. 9, the plug 3 includes a wire crimp portion 30 and an inserted portion 31.

(Plug 3: Wire Crimp Portion 30)

As shown in FIG. 9, the wire crimp portion 30 is a portion for attaching the wire 2 to the plug 3. The wire crimp portion 30 includes a wire connecting portion 32 which is crimped to electrically connect the strand wire 25 of the wire 2, and a wire holding portion 33 which holds the insulation 26 of the wire 2 so as to prevent a load in the connector inserting/removing direction from being applied to the wire connecting portion 32.

(Plug 3: Inserted Portion 31)

The inserted portion 31 is a portion to be inserted into the accommodating portion 11 of the receptacle body 6 of the receptacle 5. As shown in FIGS. 9 to 12, the inserted portion 31 includes a body plate 35, an elastic piece 36 which is elastically supported in a cantilevered manner by the body plate 35, and a pair of side plates 37*a* and 37*b*.

The body plate 35 is connected to the wire crimp portion 30. The elastic piece 36 is connected to an end in the inserting direction of the body plate 35, and extends in the removing direction. The elastic piece 36 is formed to be slightly inclined with respect to the body plate 35 in such a manner that the elastic piece 36 is gradually separated from the body plate 35 toward the removing direction. The elastic piece 36 is disposed to be sandwiched between the pair of side plates 37*a* and 37*b*.

(Plug 3: Inserted Portion 31: Elastic Piece 36)

Figure 11:
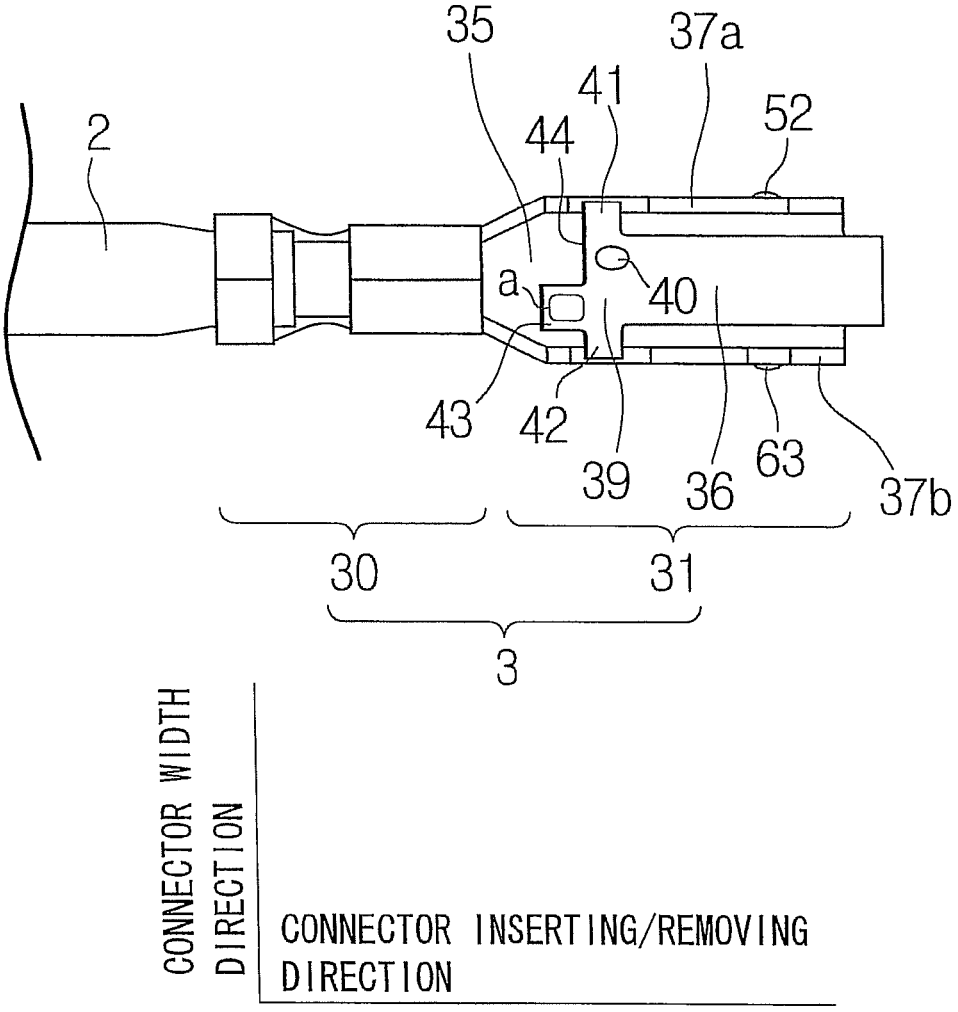
FIG. 11 is a plan view of the plug connected with the wire (first exemplary embodiment)
Figure 12:
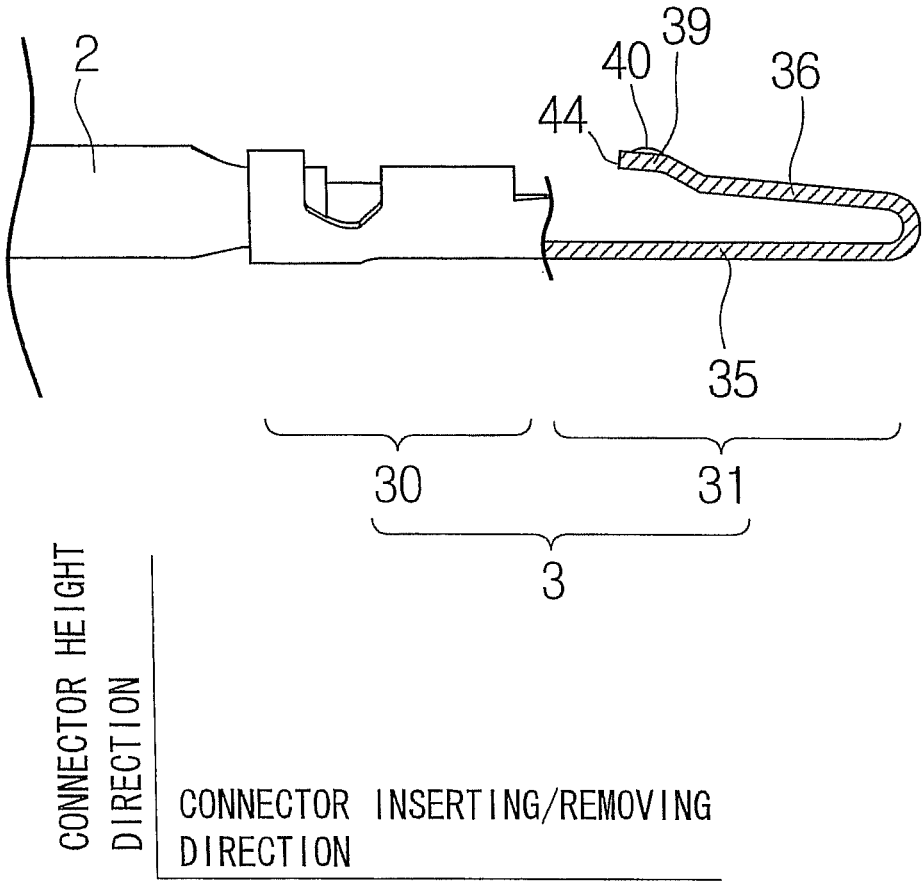
FIG. 12 is a sectional view of an elastic piece of the plug connected with the wire (first exemplary embodiment)

As shown in FIGS. 9, 11, and 12, a curved contact portion 40 (contact portion), a first width-direction projection 41, a second width-direction projection 42, an externally exposed portion 43, and an engagement surface 44 are formed at a free end 39 (first engagement portion) of the elastic piece 36.

As shown in FIG. 12, the curved contact portion 40 swells out in the mounting surface separating direction from the free end 39 so as to have a curved surface. Accordingly, it can be said that the curved contact portion 40 is formed in the vicinity of the free end 39.

As shown in FIGS. 9 and 11, the first width-direction projection 41 protrudes from the free end 39 of the elastic piece 36 in the connector width anti-center direction. Specifically, the first width-direction projection 41 protrudes from the free end 39 of the elastic piece 36 in the connector width anti-center direction, i.e., toward the side plate 37*a*.

Similarly, as shown in FIGS. 9 and 11, the second width-direction projection 42 protrudes from the free end 39 of the elastic piece 36 in the connector width anti-center direction. Specifically, the second width-direction projection 42 protrudes from the free end 39 of the elastic piece 36 in the connector width anti-center direction, i.e., toward the side plate 37*b*.

As shown in FIGS. 9 and 11, the externally exposed portion 43 connects to the free end 39 of the elastic piece 36 and protrudes from the free end 39 of the elastic piece 36 in the removing direction, so that the externally exposed portion 43 has a pressing area "a" shown in FIG. 11. Specifically, as shown in FIG. 11, the externally exposed portion 43 is disposed at a position closer to the side plate 37*b*.

As shown in FIG. 11, the engagement surface 44 is an edge surface of the free end 39 of the elastic piece 36 in the removing direction, and is formed at a position closer to the side plate 37*a*.

(Plug 3: Inserted Portion 31: Side Plate 37*a*)

Figure 10:
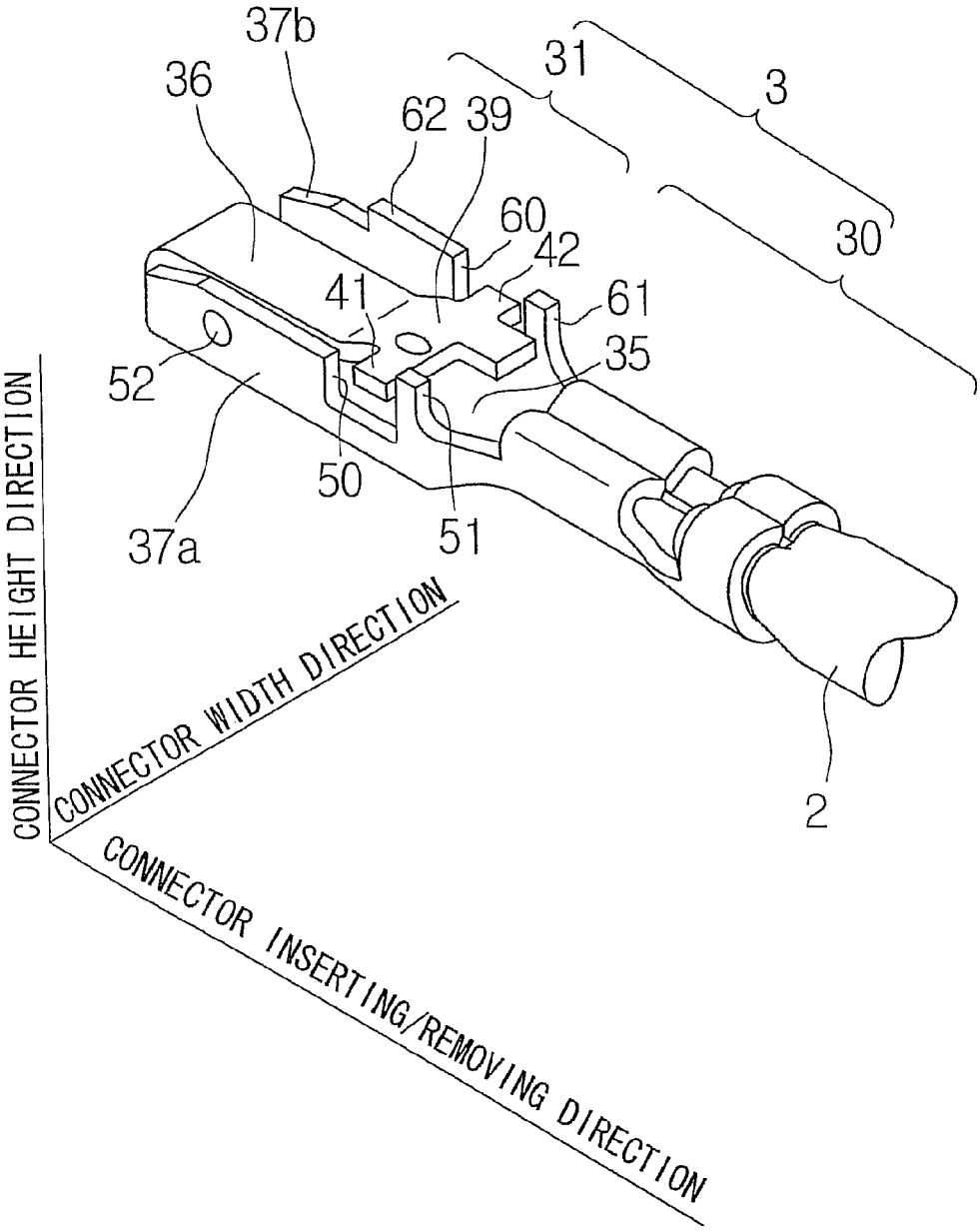
FIG. 10 is another perspective view of the plug connected with the wire (first exemplary embodiment)

As shown in FIG. 10, the side plate 37*a* has a notch 50, a stopper projection 51 (excessive insertion preventing portion), and a raised portion 52. The notch 50 is formed be opened in the mounting surface separating direction on the side of the removing direction of the side plate 37*a*. The notch 50 accommodates the first width-direction projection 41 of the elastic piece 36, and the depth of the notch is adjusted so as to prevent excessive deformation of the elastic piece 36. The stopper projection 51 is formed to be adjacent to the notch 50 in the removing direction. The stopper projection 51 is formed to be higher in the connector height direction than the other portions of the side plate 37*a*. The raised portion 52 is formed on the side of the inserting direction of the side plate 37*a* so as to be raised from the side plate 37*a* in the connector width anti-center direction.

(Plug 3: Inserted Portion 31: Side Plate 37*b*)

As shown in FIGS. 10 and 11, the side plate 37*b* has a notch 60, a stopper projection 61 (which does not function as the excessive insertion preventing portion in this exemplary embodiment), a key 62 (erroneous insertion preventing portion, excessive insertion preventing portion), and a raised portion 63. The notch 60 is formed on the side of the removing direction of the side plate 37*b* so as to be opened in the mounting surface separating direction. The notch 60 accommodates the second width-direction projection 42 of the elastic piece 36, and the depth of the notch is adjusted so as to prevent excessive deformation of the elastic piece 36. In this regard, the notch 60 exerts substantially the same functions as that of the notch 50. The stopper projection 61 is formed to be adjacent to the notch 60 in the removing direction. The key 62 is formed to be adjacent to the notch 60 in the inserting direction. The stopper projection 61 and the key 62 are formed to be higher in the connector height direction than the other portions of the side plate 37*b*. As shown in FIG. 11, the raised portion 63 is formed on the side of the inserting direction of the side plate 37*b* so as to be raised from the side plate 37*b* in the connector width anti-center direction.

(Operation: FIGS. 13 to 19)

Next, the operation of the wire-to-board connector 1 will be described.

Referring first to FIG. 1, the pair of mounting portions 7 of the receptacle 5 is soldered to a pair of electrode pads 4*b* formed on the connector mounting surface 4*a* of the circuit board 4.

Figure 13:
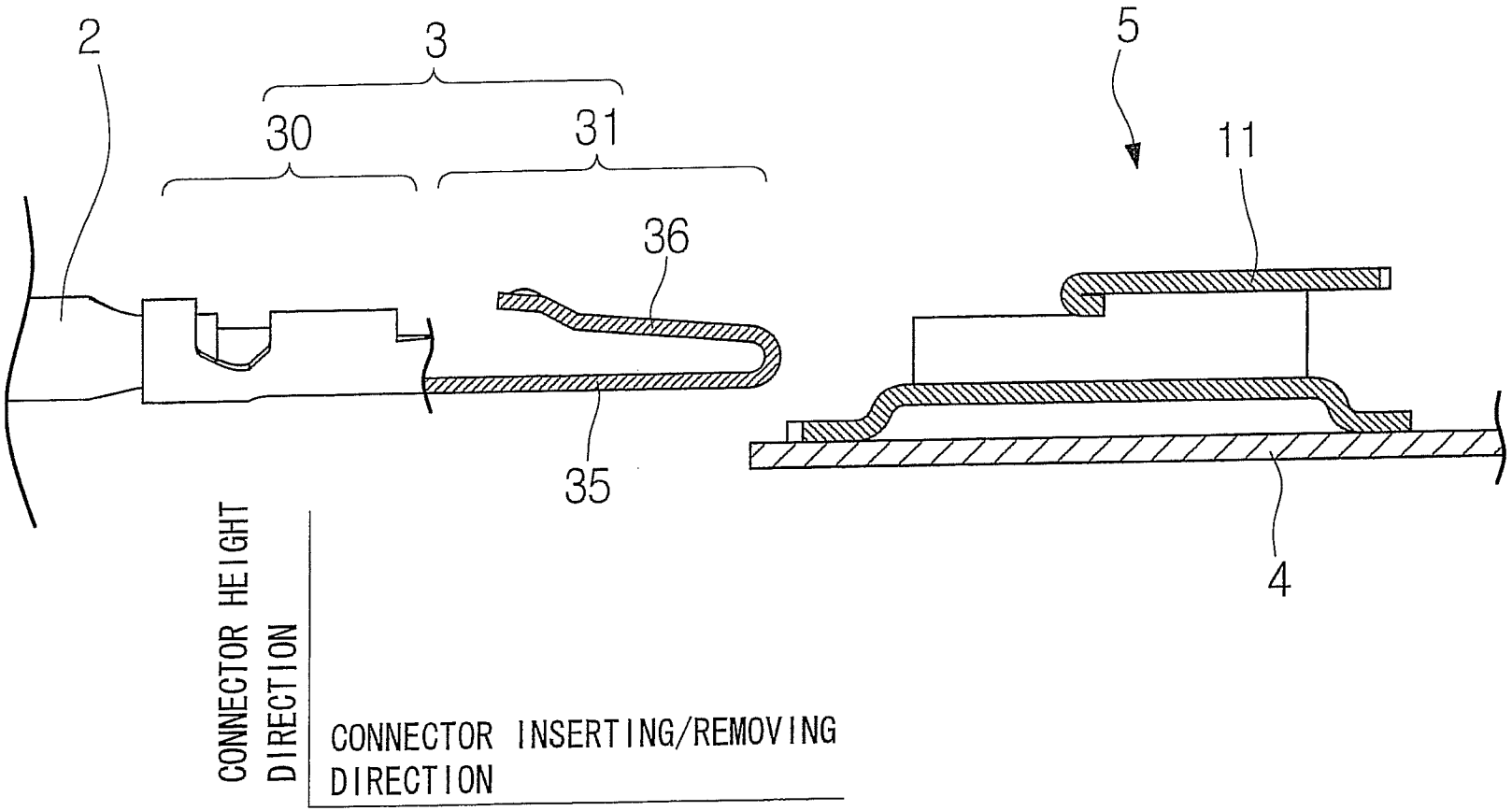
FIG. 13 is a first explanatory diagram for explaining insertion of the plug into the receptacle (first exemplary embodiment)
Figure 14:
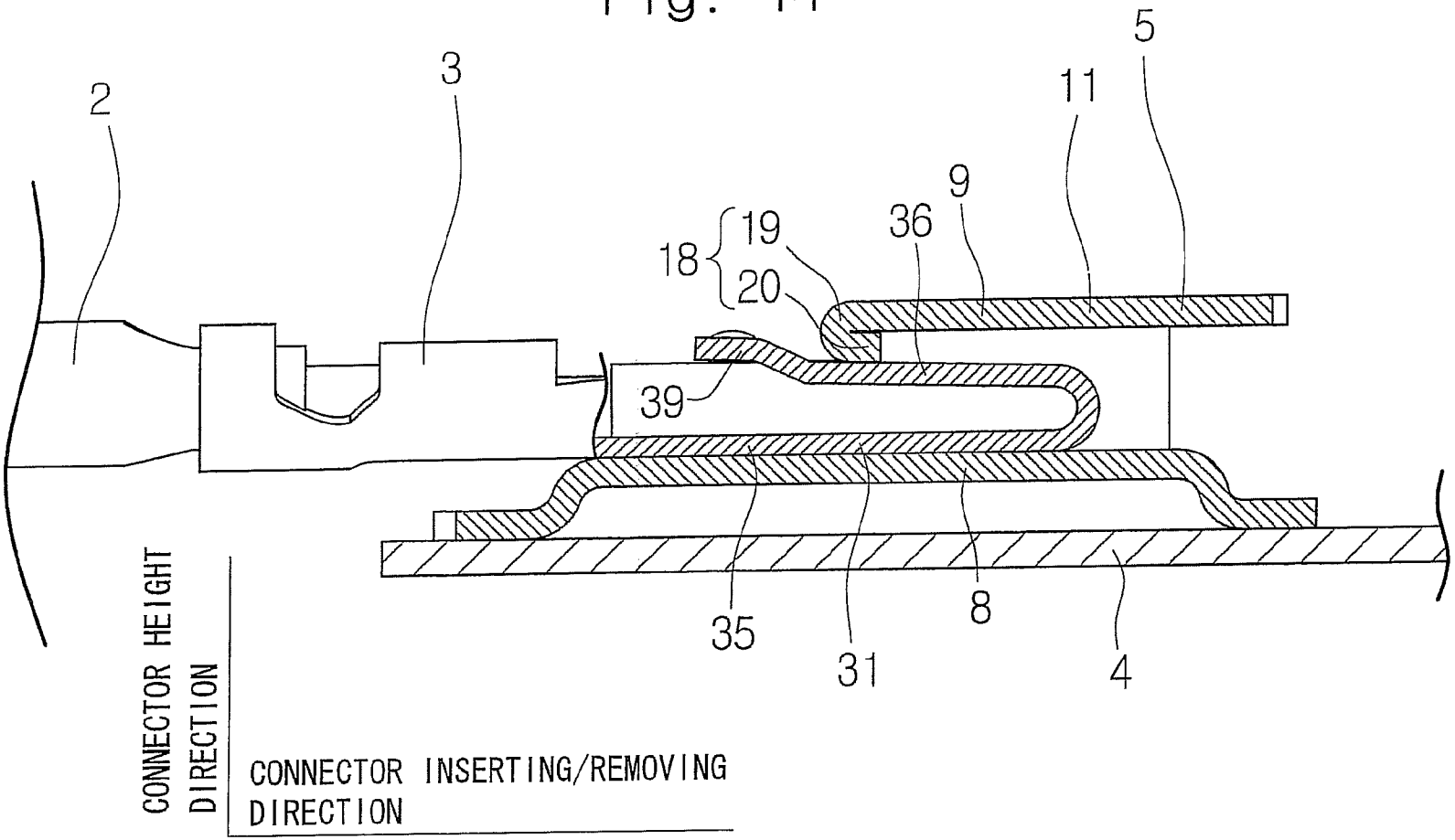
FIG. 14 is a second explanatory diagram for explaining insertion of the plug into the receptacle (first exemplary embodiment)
Figure 15:
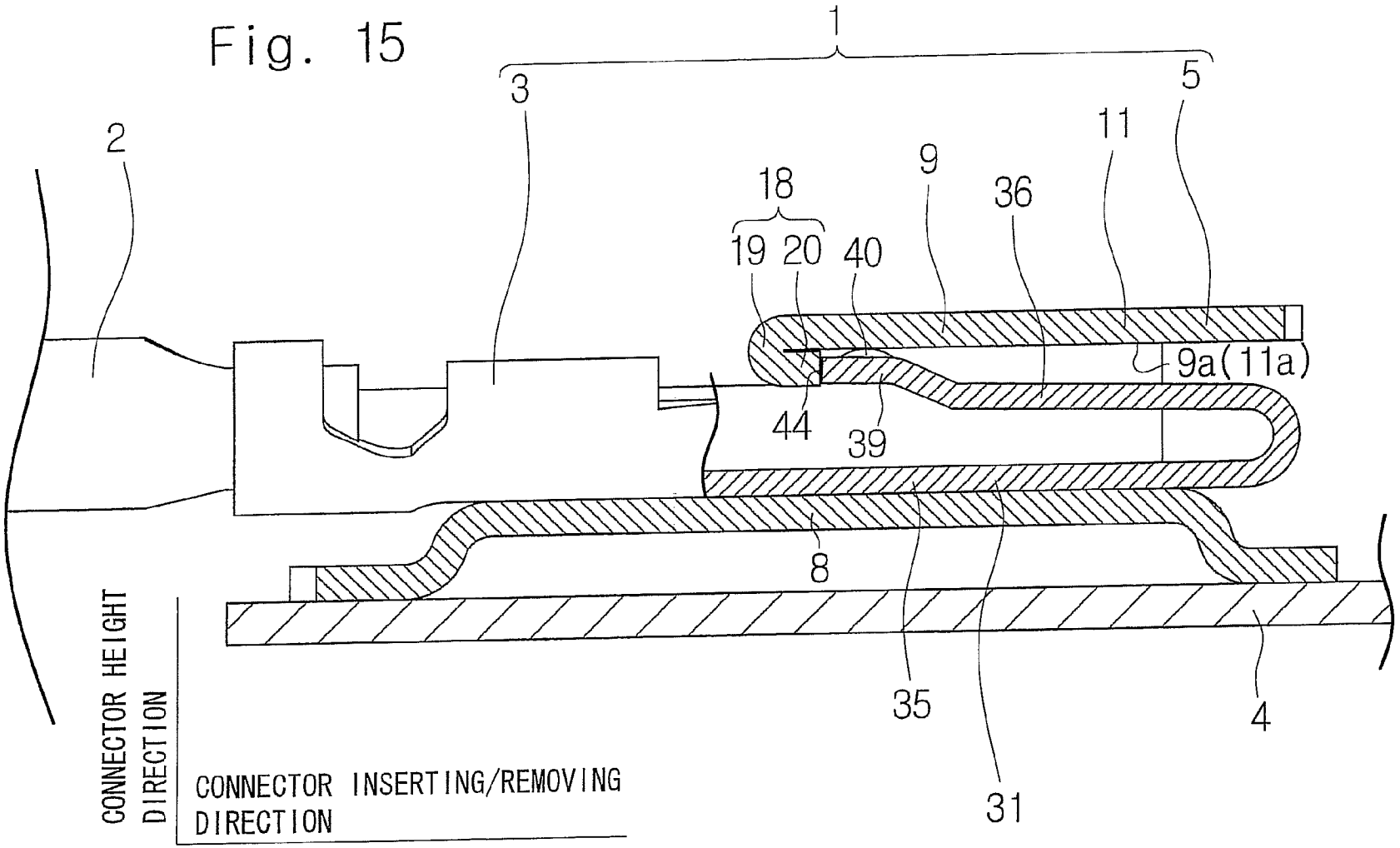
FIG. 15 is a third explanatory diagram for explaining insertion of the plug into the receptacle (first exemplary embodiment)

Referring next to FIG. 13, the wire 2 is crimped to the wire crimp portion 30 of the plug 3, and then the attitude of the plug 3 with respect to the receptacle 5 is adjusted such that the elastic piece 36 of the plug 3 is located on the side of the mounting surface separating direction when viewed from the body plate 35. In this state, as shown in FIGS. 13 to 15, the inserted portion 31 of the plug 3 is inserted into the accommodating portion 11 of the receptacle 5. At this time, the plug guide portion 10*c* shown in FIG. 6 exerts the function as a guide for guiding the inserted portion 31 of the plug 3 into the space between the side plates 10*a* and 10*b*. The base plate 8 shown in FIG. 6 extends from the accommodating portion 11 in the removing direction, thereby exerting the function as the guide for guiding the inserted portion 31 into the accommodating portion 11.

As shown in FIG. 14, when the inserted portion 31 of the plug 3 is inserted into the accommodating portion 11 of the receptacle 5, the elastic piece 36 of the inserted portion 31 of the plug 3 is pressed down in the mounting surface approaching direction by the curved portion 19 and the engaged portion 20 of the receptacle-side engaging portion 18 formed at the top plate 9 of the accommodating portion 11.

In the state shown in FIG. 14, when the inserted portion 31 of the plug 3 is further inserted into the accommodating portion 11 of the receptacle 5, the free end 39 of the inserted portion 31 of the plug 3 runs over the engaged portion 20 of the receptacle-side engaging portion 18 of the receptacle 5. Further, as shown in FIG. 15, the free end 39 is displaced in the mounting surface separating direction along with an elastic deformation of the elastic piece 36 and engages with the engaged portion 20. As a result, the plug 3 is fitted into the receptacle 5 (also see FIGS. 1 to 3).

Figure 18:
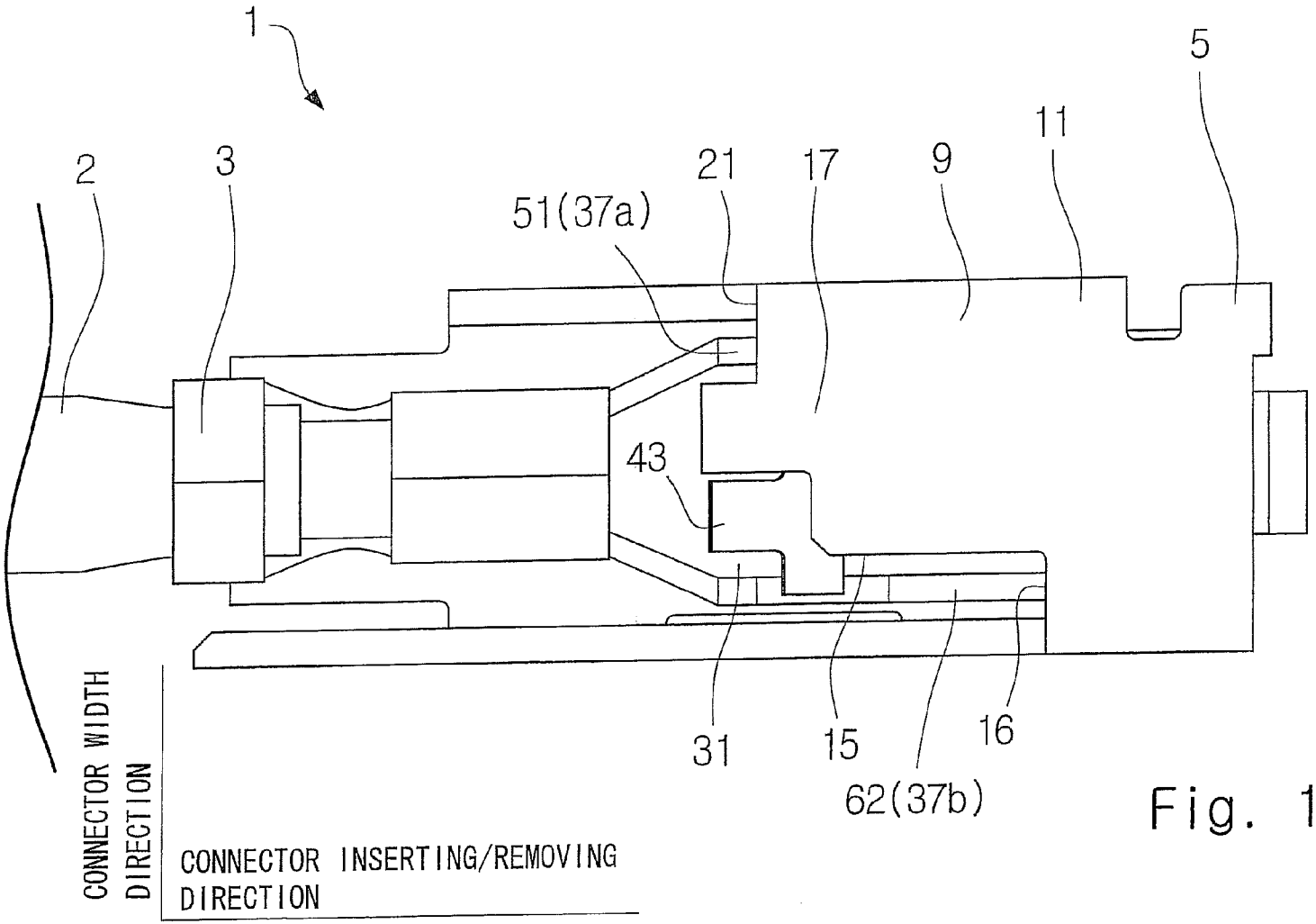
FIG. 18 is a fifth explanatory diagram for explaining insertion of the plug into the receptacle (first exemplary embodiment)

As shown in FIG. 15, in the state where the free end 39 engages with the engaged portion 20, the externally exposed portion 43 of the plug 3 is externally exposed without being covered by the accommodating portion 11 of the receptacle 5 as shown in FIG. 3 (also see FIG. 18).

As shown in FIG. 15, the free end 39 of the plug 3 and the engaged portion 20 of the receptacle 5 engage with each other in substantially parallel to each other in the inserting direction. Specifically, the engagement surface 44 formed on the free end 39 of the plug 3 contacts the engaged portion 20 of the receptacle 5 in substantially parallel to the inserting direction. In the state where the free end 39 and the engaged portion 20 engage with each other, the elastic piece 36 contacts an inner peripheral surface 11*a* of the accommodating portion 11 (that is, an inner surface 9*a* of the top plate 9) in the vicinity of the free end 39 due to the spring elastic force of the elastic piece 36. Specifically, in the state where the free end 39 and the engaged portion 20 engage with each other, the curved contact portion 40 of the elastic piece 36 contacts the inner peripheral surface 11*a* of the accommodating portion 11 (that is, the inner surface 9*a* of the top plate 9) due to the spring elastic force of the elastic piece 36. A contact between the curved contact portion 40 of the elastic piece 36 of the plug 3 and the inner peripheral surface 11*a* of the accommodating portion 11 of the receptacle 5 functions as a main contact between the plug 3 and the receptacle 5. At this time, the base plate 8 and the body plate 35 contact each other in the connector height direction.

Figure 16:
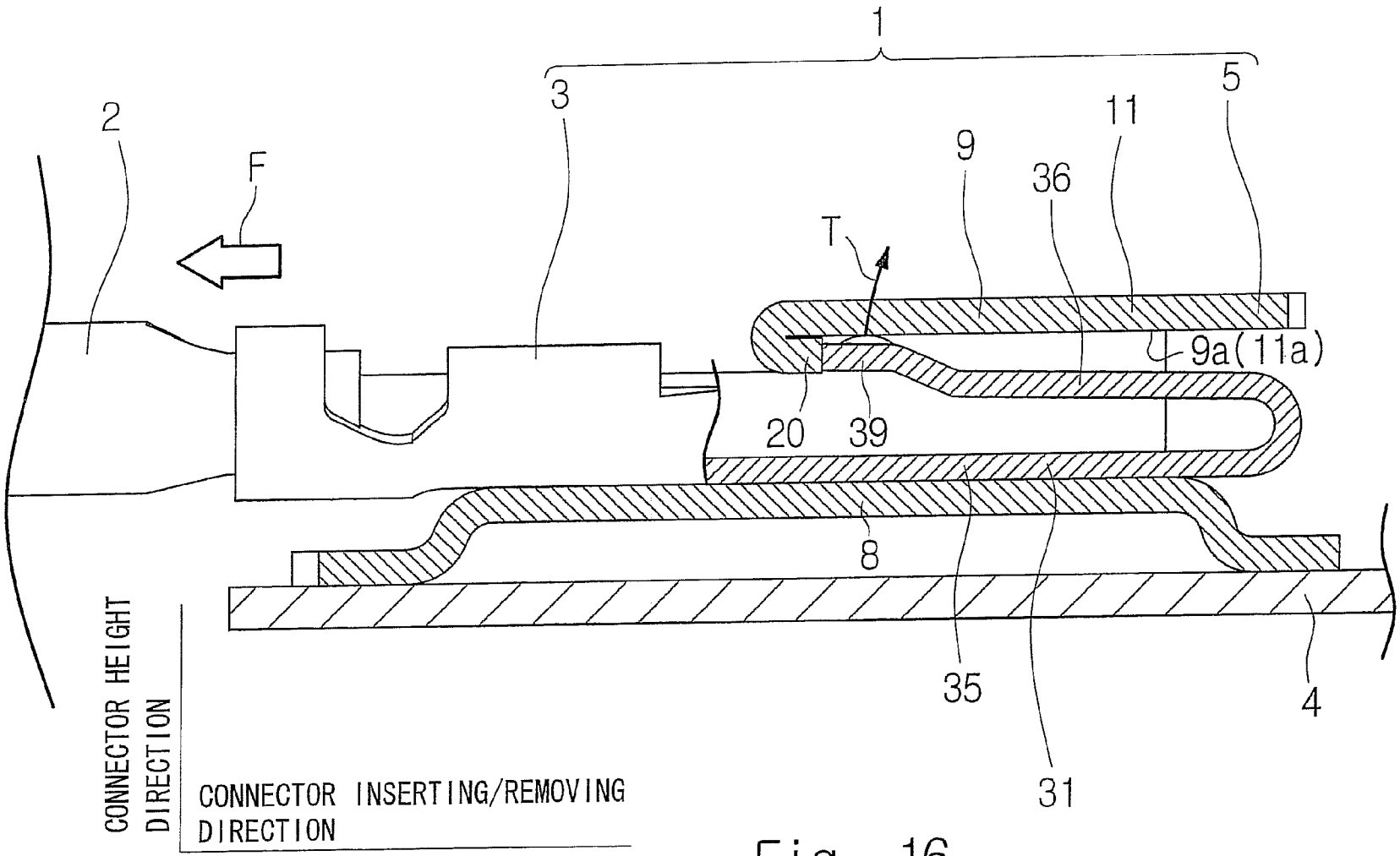
FIG. 16 is an operation explanatory diagram of the wire-to-board connector when an external force acts on the wire (first exemplary embodiment)

In the state shown in FIG. 15, when an external force F acts on the wire 2 in the removing direction as shown in FIG. 16, the free end 39 is to be displaced in the direction separating from the body plate 35 (that is, in the mounting surface separating direction) as indicated by an arrow T, thereby maintaining the engagement with the engaged portion 20.

Figure 17:
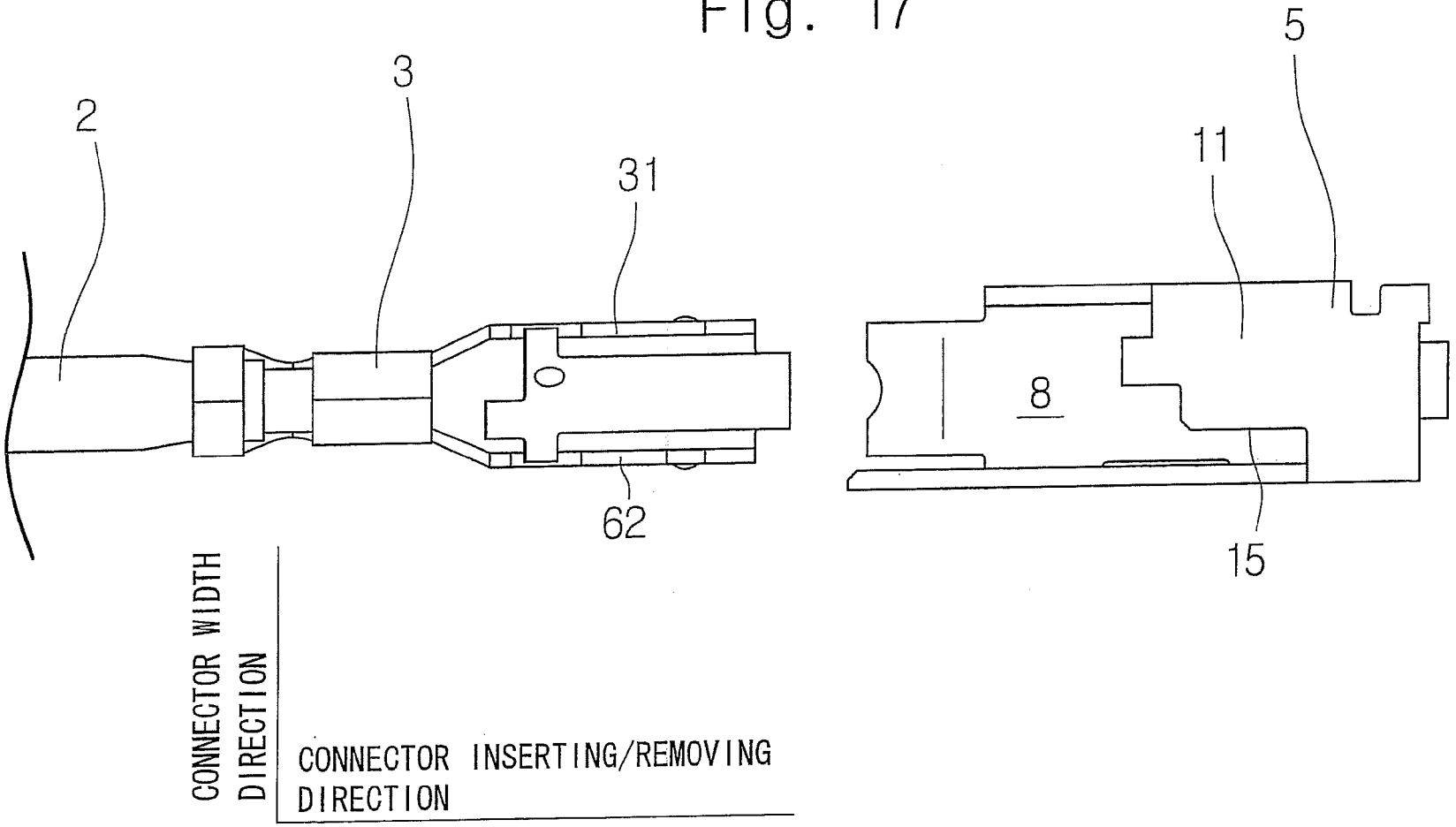
FIG. 17 is a fourth explanatory diagram for explaining insertion of the plug into the receptacle (first exemplary embodiment)

Referring next to FIGS. 17 and 18, the operation of the wire-to-board connector 1 in plan view will be described.

As shown in FIGS. 17 and 18, when the inserted portion 31 of the plug 3 is inserted into the accommodating portion 11 of the receptacle 5, the free end 39 of the inserted portion 31 of the plug 3 engages with the engaged portion 20 of the accommodating portion 11 of the receptacle 5 (also see FIG. 15), so that the plug 3 is fitted into the receptacle 5 as shown in FIG. 18. In this state, when the inserted portion 31 of the plug 3 is further inserted into the accommodating portion 11 of the receptacle 5, the stopper projection 51 of the side plate 37*a* of the inserted portion 31 of the plug 3 contacts the stopper edge surface 21 formed at the end 17 of the top plate 9 of the accommodating portion 11 of the receptacle 5, thereby inhibiting further insertion. Similarly, the key 62 of the side plate 37*b* of the inserted portion 31 of the plug 3 contacts the slit defining edge surface 16 of the top plate 9 of the accommodating portion 11 of the receptacle 5, thereby inhibiting further insertion. In other words, the stopper projection 51 and the key 62 exert the function of preventing excessive insertion of the inserted portion 31 into the accommodating portion 11.

As shown in FIGS. 17 and 18, in the case of inserting the inserted portion 31 of the plug 3 into the accommodating portion 11 of the receptacle 5, the key 62 of the inserted portion 31 of the plug 3 is inserted into the slit 15 of the accommodating portion 11 of the receptacle 5. The presence of the slit 15 and the key 62 prevents erroneous insertion of the inserted portion 31 into the accommodating portion 11. The term "erroneous insertion" herein described refers to an act of inserting the plug 3 into the receptacle 5 in the state where the plug 3 is reversed from the attitude shown in FIG. 17, for example. When the plug 3 is to be inserted into the receptacle 5 in the state where the plug 3 is reversed from the attitude shown in the figure, the key 62 of the inserted portion 31 of the plug 3 physically interferes with the base plate 8 of the receptacle 5, resulting in inhibiting the insertion of the inserted portion 31 into the accommodating portion 11. The key 62 of the inserted portion 31 of the plug 3 is formed at substantially the center in the inserting direction of the inserted portion 31. Accordingly, in the case of inserting the inserted portion 31 into the accommodating portion 11, the presence or absence of erroneous insertion can be found at a relatively early stage.

Figure 19:
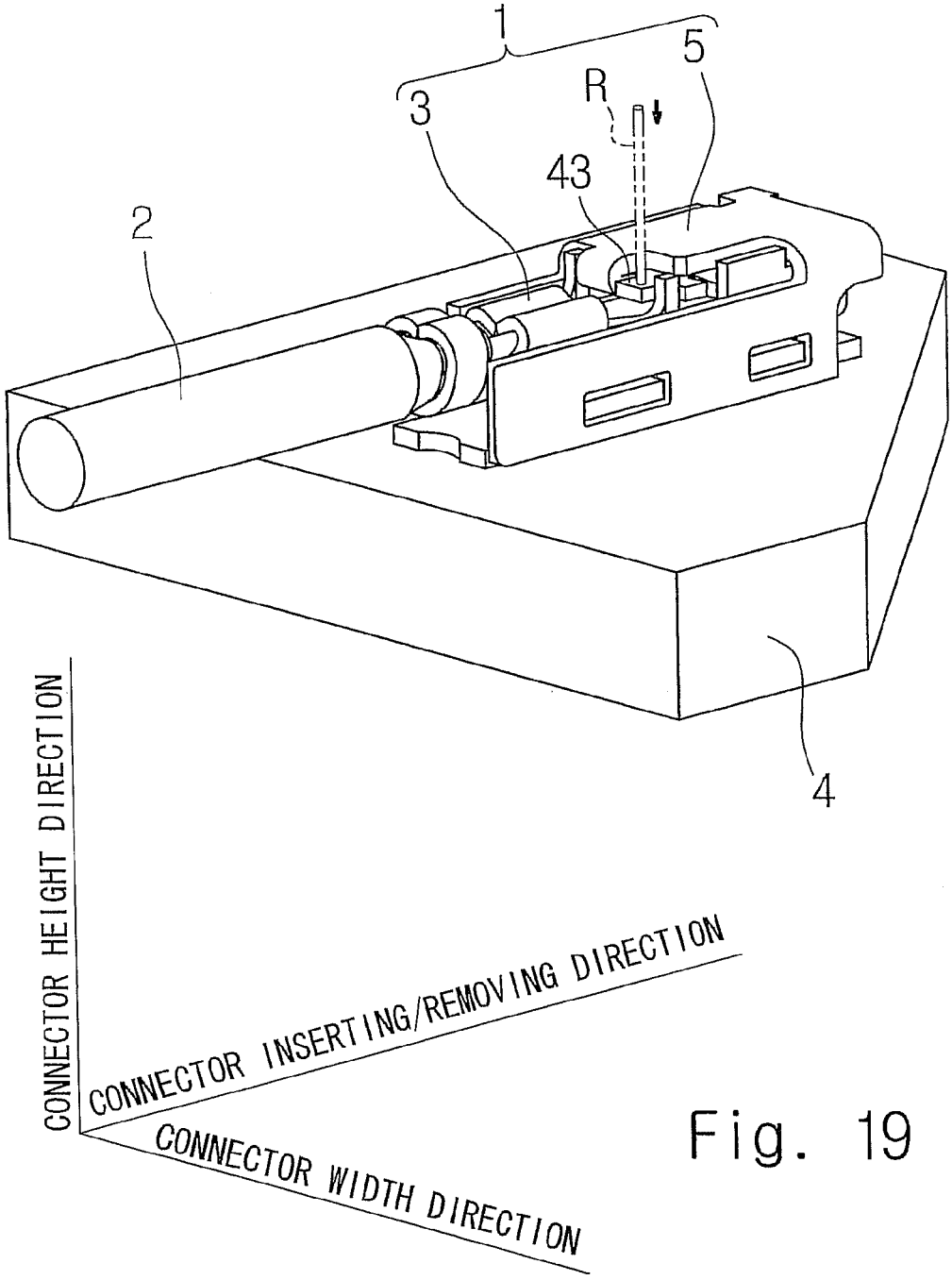
FIG. 19 is an explanatory diagram illustrating a method for releasing a fitted state of the wire-to-board connector (first exemplary embodiment)

Referring next to FIG. 19, a method for releasing the fitted state of the wire-to-board connector 1 will be described. In the state where the free end 39 engages with the engaged portion 20 as shown in FIG. 15, the externally exposed portion 43 of the inserted portion 31 of the plug 3 is externally exposed without being covered by the accommodating portion 11 of the receptacle 5 as shown in FIGS. 3, 18, and 19. Accordingly, to extract the plug 3 from the receptacle 5, the externally exposed portion 43 may be manipulated so as to be pressed down in the mounting surface approaching direction by using an elongated jig R indicated by long dashed double-short dashed lines, for example, as shown in FIG. 19. Specifically, the pressing area "a" (also see FIG. 11) of the externally exposed portion 43 may be manipulated so as to be pressed down in the mounting surface approaching direction by using the elongated jig R indicated by long dashed double-short dashed lines, for example. According to this manipulation, the elastic piece 36 shown in FIG. 15 is forcibly elastically deformed in the mounting surface approaching direction, thereby releasing the engagement between the free end 39 and the engaged portion 20. After the engagement between the free end 39 and the engaged portion 20 is released, the wire 2 can be gripped to extract the plug 3 from the receptacle 5.

While the first exemplary embodiment of the present invention has been described above, the first exemplary embodiment has the following features.

The wire-to-board connector 1 includes the plug 3 (first terminal) which is attached to the wire 2, and the receptacle 5 (second terminal) which is mounted on the circuit board 4. The plug 3 and the receptacle 5 are each formed of metal. The plug 3 is fitted into the receptacle 5, thereby electrically connecting the wire 2 to the circuit board 4. The receptacle 5 includes the accommodating portion 11 which is formed in a tubular shape. The plug 3 includes the inserted portion 31 to be inserted into the accommodating portion 11 of the receptacle 5. The inserted portion 31 includes the body plate 35 and the elastic piece 36 which is elastically supported in a cantilevered manner by the body plate 35. The elastic piece 36 of the inserted portion 31 has the free end 39 (first engagement portion). The accommodating portion 11 has the engaged portion 20 (second engagement portion). When the inserted portion 31 is inserted into the accommodating portion 11, the free end 39 engages with the engaged portion 20 along with an elastic deformation of the elastic piece 36. As a result, the plug 3 and the receptacle 5 are fitted together. According to the structure described above, the amount of displacement of the free end 39 upon engagement of the free end 39 with the engaged portion 20 can be effectively secured, and thus the engagement between the free end 39 and the engaged portion 20 can be ensured. This prevents the fitted state of the wire-to-board connector 1 from being easily released even when an external force acts on the wire 2.

As shown in FIG. 9, the elastic piece 36 extends in the removing direction which is a direction opposite to the inserting direction in which the inserted portion 31 is inserted into the accommodating portion 11.

As shown in FIG. 15, the free end 39 and the engaged portion 20 engage with each other in substantially parallel to the inserting direction.

As shown in FIG. 7, the accommodating portion 11 has the engaged portion 20 (inner protrusion) protruding toward the inner peripheral side of the accommodating portion 11.

As shown in FIG. 7, the engaged portion 20 is formed by bending the end 17 in the removing direction of the accommodating portion 11. Specifically, the engaged portion 20 is formed by bending the end 17 in the removing direction of the accommodating portion 11 by about 180 degrees.

As shown in FIG. 15, in the state where the free end 39 and the engaged portion 20 engage with each other, the elastic piece 36 contacts the inner peripheral surface 11*a* of the accommodating portion 11 in the vicinity of the free end 39 due to the spring elastic force of the elastic piece 36. The structure described above has the following technical meaning. That is, as shown in FIG. 16, when the external force F acts on the wire 2 in the removing direction, the free end 39 is to be displaced in the direction separating from the body plate 35, thereby maintaining the state in which the free end 39 and the engaged portion 20 engage with each other. This makes it more difficult to release the fitted state of the wire-to-board connector 1.

As shown in FIG. 15, the curved contact portion 40 (contact portion) is formed in the vicinity of the free end 39 of the elastic piece 36. In the state where the free end 39 and the engaged portion 20 engage with each other, the curved contact portion 40 of the elastic piece 36 contacts the accommodating portion 11 due to the spring elastic force of the elastic piece 36. According to the structure described above, the elastic piece 36 has a function of allowing the free end 39 to engage with the engaged portion 20, as well as a function of securing the contact pressure of the curved contact portion 40 with respect to the accommodating portion 11. This contributes to the simple structure of the wire-to-board connector 1.

As shown in FIGS. 3 and 18, the elastic piece 36 has the externally exposed portion 43 which is exposed to the outside without being covered by the accommodating portion 11 in the state where the free end 39 and the engaged portion 20 engage with each other. According to the structure described above, the elastic piece 36 is forcibly elastically deformed by manipulating the externally exposed portion 43 as shown in FIG. 19 in the state where the free end 39 and the engaged portion 20 engage with each other, thereby making it possible to release the engagement between the free end 39 and the engaged portion 20.

As shown in FIG. 18, the plug 3 has the stopper projection 51 (excessive insertion preventing portion) and the key 62 (excessive insertion preventing portion), each of which contacts the receptacle 5 to thereby prevent excessive insertion of the inserted portion 31 into the accommodating portion 11. According to the structure described above, it is possible to prevent excessive insertion of the inserted portion 31 into the accommodating portion 11.

As shown in FIG. 18, the accommodating portion 11 has the slit 15. The inserted portion 31 has the key 62 (erroneous insertion preventing portion) to be inserted into the slit 15. According to the structure described above, it is possible to prevent erroneous insertion of the inserted portion 31 into the accommodating portion 11.

In this exemplary embodiment, the key 62 exerts both the function of preventing excessive insertion of the inserted portion 31 into the accommodating portion 11 and the function of preventing erroneous insertion of the inserted portion 31 into the accommodating portion 11. In other words, the key 62 serves as the excessive insertion preventing portion that prevents excessive insertion of the inserted portion 31 into the accommodating portion 11, and also serves as the erroneous insertion preventing portion that prevents erroneous insertion of the inserted portion 31 into the accommodating portion 11.

As shown in FIG. 9, the inserted portion 31 has the pair of side plates 37*a* and 37*b* which are opposed to each other. According to the structure described above, the attitude of the inserted portion 31 in the accommodating portion 11 is stabilized.

As shown in FIG. 9, the elastic piece 36 is formed between the pair of side plates 37*a* and 37*b*.

As shown in FIG. 4, the accommodating portion 11 includes the base plate 8 which is formed on the side of the circuit board 4, the top plate 9 and the pair of side plates 10*a* and 10*b* which couple the top plate 9 with the base plate 8. The accommodating portion 11 is formed in a substantially angular cylindrical shape.

Figure 6:
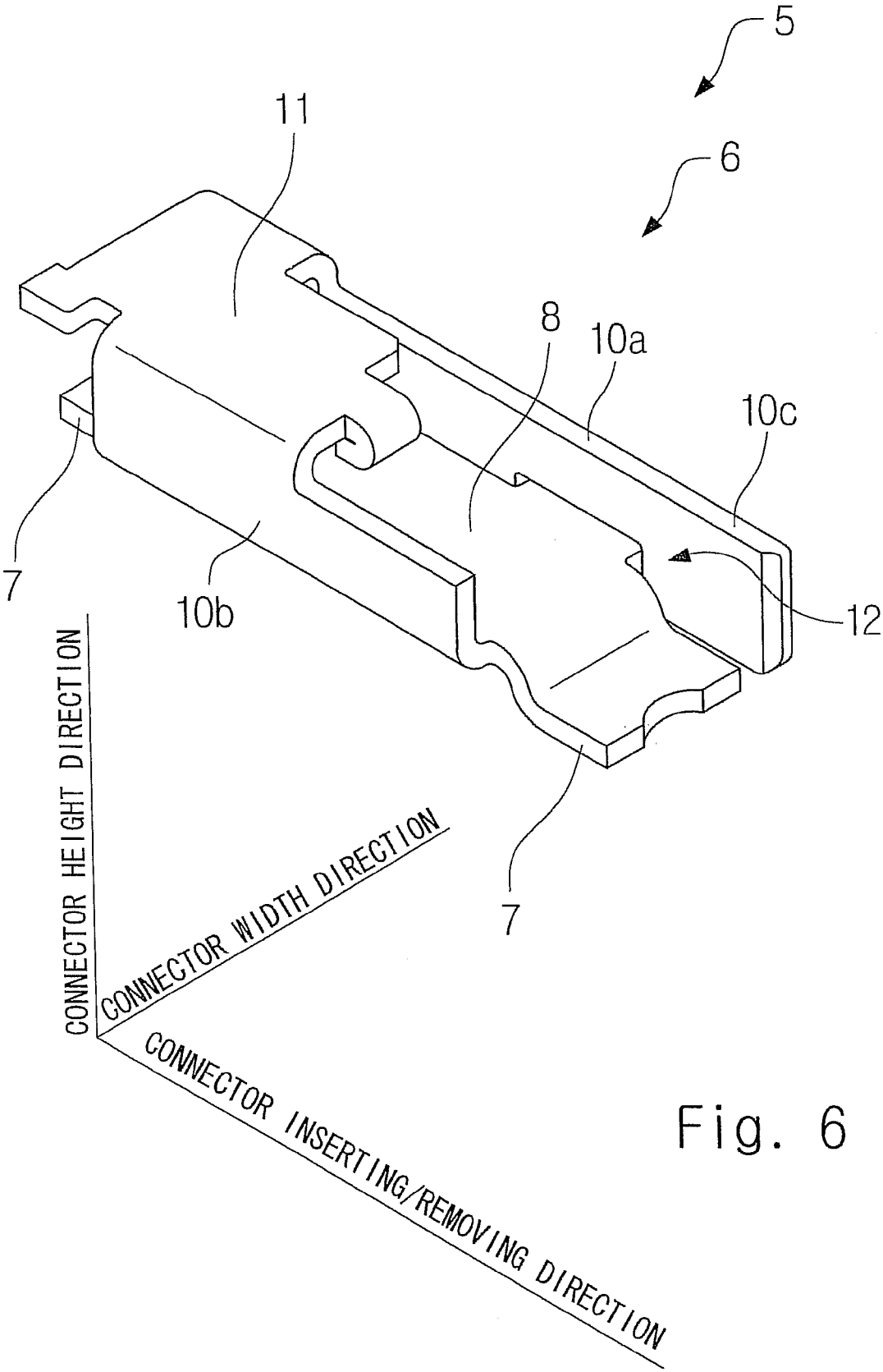
FIG. 6 is a perspective view of the receptacle when viewed from still another angle (first exemplary embodiment)

As shown in FIG. 6, the base plate 8 of the accommodating portion 11 extends in the removing direction which is a direction opposite to the inserting direction in which the inserted portion 31 is inserted into the accommodating portion 11. According to the structure described above, the inserted portion 31 can be smoothly inserted into the accommodating portion 11 by using the base plate 8.

As shown in FIG. 4, the accommodating portion 11 is formed in a tubular shape by sheet metal bending. The pair of shape holding mechanisms E for holding the tubular shape of the accommodating portion 11 is formed at the joint 12 of the accommodating portion 11. Each shape holding mechanism E is implemented by the shape holding projection 13 and the shape holding projection accommodating hole 14 which accommodates the shape holding projection 13.

(Second Exemplary Embodiment)

Next, a second exemplary embodiment of the present invention will be described with reference to FIG. 20. Herein, differences between the first exemplary embodiment and the second exemplary embodiment are mainly described, and a repeated description is omitted as needed. The components corresponding to the components of the first exemplary embodiment are denoted by the same reference numerals as a rule.

Figure 20:
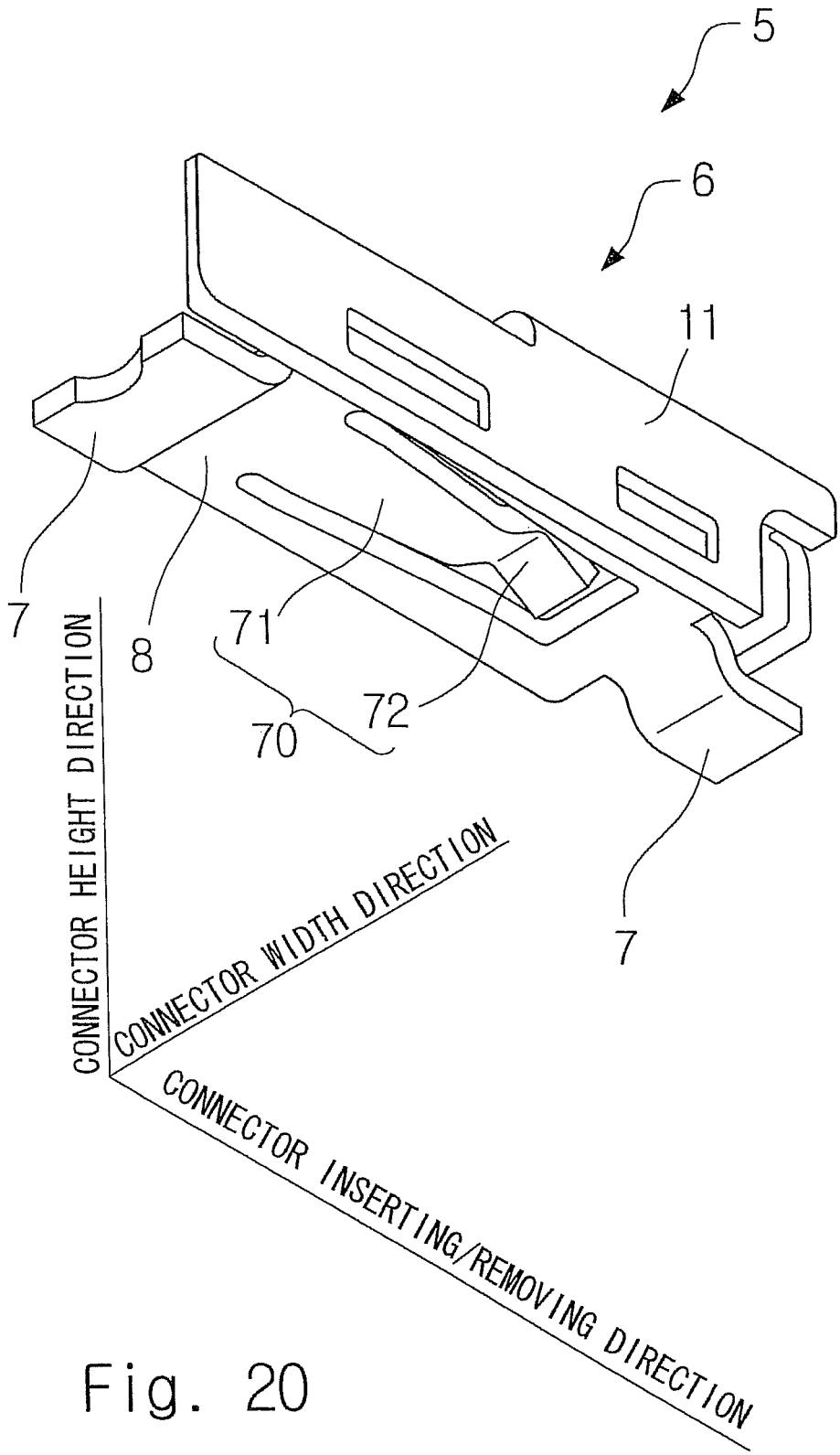
FIG. 20 is a perspective view of a receptacle (second exemplary embodiment)
Figure 21:
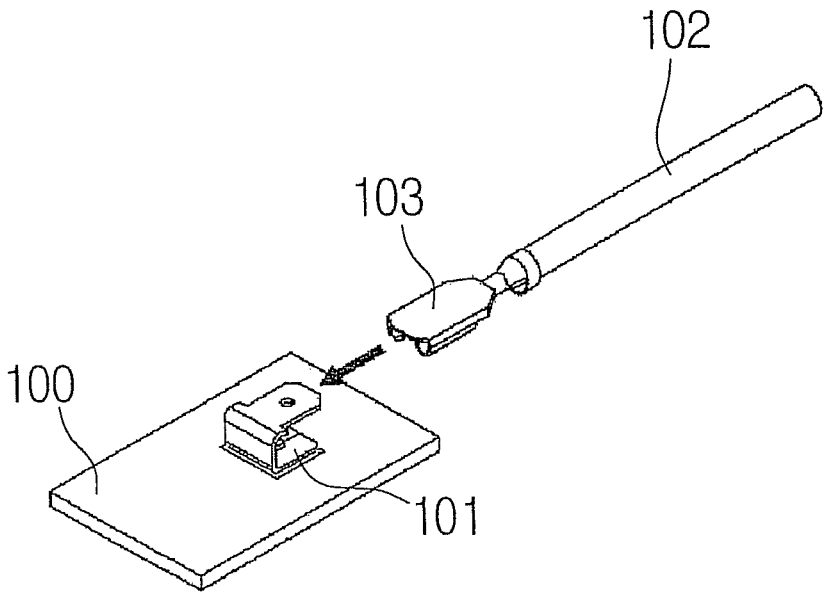
FIG. 21 is a diagram corresponding to FIG. 1 of Japanese Unexamined Patent Application Publication No. 2010-186663.

As shown in FIG. 20, in this exemplary embodiment, the base plate 8 has a contact spring piece 70 which is formed in a cantilevered manner. The contact spring piece 70 is formed by cutting and raising the central portion of the base plate 8. The contact spring piece 70 includes a support spring piece 71 which is supported in a cantilevered manner by the base plate 8, and a contact portion 72 which is formed at a free end of the support spring piece 71. The contact portion 72 protrudes toward the internal space of the accommodating portion 11 in a non-load state of the contact spring piece 70. In the structure described above, when the inserted portion 31 of the plug 3 is inserted into the accommodating portion 11 of the receptacle 5 as shown in FIG. 15, the contact portion 72 of the contact spring piece 70 shown in FIG. 20 is allowed to strongly contact the body plate 35 of the inserted portion 31 of the plug 3 due to the spring elastic force of the support spring piece 71. Accordingly, a contact between the contact portion 72 of the contact spring piece 70 and the body plate 35 of the inserted portion 31 of the plug 3 functions as a contact between the plug 3 and the receptacle 5.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A wire-to-board connector comprising a first terminal attached to a wire, and a second terminal mounted on a circuit board, the first terminal and the second terminal being formed of metal and fitted together to electrically connect the wire to the circuit board, wherein the second terminal includes an accommodating portion formed in a tubular shape, the first terminal includes an inserted portion to be inserted into the accommodating portion of the second terminal, the inserted portion includes a body plate and an elastic piece, the elastic piece being elastically supported in a cantilevered manner by the body plate, the elastic piece of the inserted portion has a first engagement portion, and the accommodating portion has a second engagement portion, and when the inserted portion is inserted into the accommodating portion, the first engagement portion runs over and engages with the second engagement portion along with an elastic deformation of the elastic piece, thereby allowing the first terminal to be fitted into the second terminal, wherein the accommodating portion has an inner protrusion protruding toward an inner peripheral side of the accommodating portion, and the inner protrusion functions as the second engagement portion, the inner protrusion is formed by bending an end in the removing direction of the accommodating portion.

2. The wire-to-board connector according to claim 1, wherein the elastic piece extends in a removing direction, the removing direction being a direction opposite to an inserting direction in which the inserted portion is inserted into the accommodating portion.

3. The wire-to-board connector according to claim 2, wherein the first engagement portion and the second engagement portion engage with each other substantially parallel to the inserting direction.

4. The wire-to-board connector according to claim 1, wherein the inner protrusion is formed by bending the end in the removing direction of the accommodating portion by about 180 degrees.

5. The wire-to-board connector according to claim 1, wherein the elastic piece contacts an inner peripheral surface of the accommodating portion near the first engagement portion due to a spring elastic force of the elastic piece, in a state where the first engagement portion and the second engagement portion engage with each other.

6. The wire-to-board connector according to claim 1, wherein the elastic piece has a contact portion that contacts the accommodating portion due to a spring elastic force of the elastic piece, in a state where the first engagement portion and the second engagement portion engage with each other.

7. The wire-to-board connector according to claim 1, wherein the elastic piece has an externally exposed portion that is exposed to an outside without being covered by the accommodating portion, in a state where the first engagement portion and the second engagement portion engage with each other.

8. The wire-to-board connector according to claim 7, wherein the externally exposed portion has a pressing area, the pressing area being formed such that the externally exposed portion connects to a free end of the elastic piece and protrudes in at least one of a connector width direction and a connector inserting/removing direction.

9. The wire-to-board connector according to claim 1, wherein the first terminal has an excessive insertion preventing portion that contacts the second terminal to prevent excessive insertion of the inserted portion into the accommodating portion.

10. The wire-to-board connector according to claim 9, wherein the accommodating portion has a slit formed therein, the inserted portion has an erroneous insertion preventing portion to be inserted into the slit, and the erroneous insertion preventing portion serves as the excessive insertion preventing portion.

11. The wire-to-board connector according to claim 1, wherein the accommodating portion has a slit formed therein, and the inserted portion has an erroneous insertion preventing portion to be inserted into the slit.

12. The wire-to-board connector according to claim 1, wherein the inserted portion has a pair of side plates opposed to each other.

13. The wire-to-board connector according to claim 12, wherein the elastic piece is formed between the pair of side plates.

14. The wire-to-board connector according to claim 1, wherein the accommodating portion includes:

a base plate located on a side of the circuit board;

a top plate; and a pair of side plates that couple the top plate with the base plate, and the accommodating portion is formed in a substantially angular cylindrical shape.

15. The wire-to-board connector according to claim 14, wherein the base plate of the accommodating portion extends in a removing direction, the removing direction being a direction opposite to an inserting direction in which the inserted portion is inserted into the accommodating portion.

16. The wire-to-board connector according to claim 14, wherein the base plate of the accommodating portion has a contact spring piece that is formed in a cantilevered manner and contacts the inserted portion inserted into the accommodating portion.

17. The wire-to-board connector according to claim 1, wherein the accommodating portion is formed in a tubular shape by sheet metal bending, a shape holding mechanism for holding a tubular shape of the accommodating portion is formed near a joint of the accommodating portion, and the shape holding mechanism is implemented by a shape holding projection and a shape holding projection accommodating hole that accommodates the shape holding projection.

18. The wire-to-board connector according to claim 1, wherein the inserted portion includes a pair of side plates opposed to each other, and at least one of the pair of side plates having an excessive insertion preventing portion that contacts the accommodating portion to prevent excessive insertion of the inserted portion into the accommodating portion.

19. The wire-to-board connector according to claim 18, wherein the excessive insertion preventing portion contacts a part of an edge surface of the accommodating portion in a removing direction to prevent excessive insertion of the inserted portion into the accommodating portion, the removing direction being a direction opposite to an inserting direction in which the accommodating portion is inserted into the accommodating portion.

* * * * *